US011448982B2

(12) United States Patent
Tominaga et al.

(10) Patent No.: US 11,448,982 B2
(45) Date of Patent: Sep. 20, 2022

(54) ELECTROPHOTOGRAPHIC APPARATUS, PROCESS CARTRIDGE, AND CARTRIDGE SET

(71) Applicant: CANON KABUSHIKI KAISHA, Tokyo (JP)

(72) Inventors: Tsuneyoshi Tominaga, Shizuoka (JP); Shohei Tsuda, Shizuoka (JP); Shohei Kototani, Shizuoka (JP); Noriyoshi Umeda, Shizuoka (JP); Masahiro Kurachi, Shizuoka (JP); Kazuhiro Yamauchi, Shizuoka (JP); Motonari Ito, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 55 days.

(21) Appl. No.: 17/071,540

(22) Filed: Oct. 15, 2020

(65) Prior Publication Data

US 2021/0116831 A1 Apr. 22, 2021

(30) Foreign Application Priority Data

Oct. 18, 2019 (JP) ..... JP2019-191585

(51) Int. Cl.
*G03G 9/097* (2006.01)
*G03G 9/087* (2006.01)
(Continued)

(52) U.S. Cl.
CPC ..... *G03G 9/09708* (2013.01); *G03G 9/0819* (2013.01); *G03G 9/08711* (2013.01);
(Continued)

(58) Field of Classification Search
CPC ..... G03G 9/09708; G03G 9/0819; G03G 9/08711; G03G 9/08797; G03G 15/0233;
(Continued)

(56) References Cited

U.S. PATENT DOCUMENTS 6,697,587 B2 2/2004 Harada
6,864,030 B2 3/2005 Shirai et al.
(Continued)

FOREIGN PATENT DOCUMENTS

JP 2002003651 A 1/2002
JP 2003107781 A 4/2003
(Continued)

OTHER PUBLICATIONS

U.S. Appl. No. 17/065,258, Kohei Makisumi, filed Oct. 7, 2020.
(Continued)

*Primary Examiner* — Ryan D Walsh
(74) *Attorney, Agent, or Firm* — Venable LLP

(57) ABSTRACT

An electrophotographic apparatus including an electrophotographic photosensitive member, a charging unit, and a developing unit, wherein the charging unit includes a conductive member disposed to be contactable with the electrophotographic photosensitive member, a conductive layer of the conductive member has a matrix-domain structure, at least some of the domains are exposed at the outer surface of the conductive member, the volume resistivity RI of the matrix is greater than $1.00\times10^{12}$ Ω·cm and not greater than $1.00\times10^{17}$ Ω·cm, the matrix volume resistivity R1 is at least $1.0\times10^{5}$-times the domain volume resistivity R2, and the developing unit includes a toner, the toner includes a binder resin-containing toner particle and an external additive, and the external additive contains fine particles of a hydrotalcite compound.

8 Claims, 6 Drawing Sheets

(51) Int. Cl.

| | |
|---|---|
| ***G03G 21/18*** | (2006.01) |
| ***G03G 15/00*** | (2006.01) |
| ***G03G 9/08*** | (2006.01) |
| ***G03G 15/02*** | (2006.01) |

(52) U.S. Cl.
CPC ..... *G03G 9/08797* (2013.01); *G03G 15/0233* (2013.01); *G03G 15/75* (2013.01); *G03G 21/1814* (2013.01)

(58) Field of Classification Search
CPC . G03G 15/75; G03G 21/1814; G03G 9/09716
See application file for complete search history.

(56) References Cited

U.S. PATENT DOCUMENTS

| | | | |
|---|---|---|---|
| 7,799,398 | B2 | 9/2010 | Nakamura et al. |
| 8,298,670 | B2 | 10/2012 | Muranaka et al. |
| 8,449,975 | B2 | 5/2013 | Hirakoso et al. |
| 8,503,916 | B2 | 8/2013 | Anan et al. |
| 8,628,854 | B2 | 1/2014 | Yamauchi et al. |
| 8,660,472 | B2 | 2/2014 | Kurachi et al. |
| 8,668,987 | B2 | 3/2014 | Yamauchi et al. |
| 8,715,830 | B2 | 5/2014 | Yamada et al. |
| 8,771,818 | B2 | 7/2014 | Nishioka et al. |
| 8,852,743 | B2 | 10/2014 | Kikuchi et al. |
| 9,023,465 | B2 | 5/2015 | Yamada et al. |
| 9,086,643 | B2 | 7/2015 | Kikuchi et al. |
| 9,128,403 | B2 | 9/2015 | Yamauchi et al. |
| 9,146,482 | B2 | 9/2015 | Watanabe et al. |
| 9,360,789 | B1 | 6/2016 | Masu et al. |
| 9,442,408 | B2 | 9/2016 | Yamauchi et al. |
| 9,442,451 | B2 | 9/2016 | Yamauchi et al. |
| 9,541,854 | B2 | 1/2017 | Kikuchi et al. |
| 9,547,250 | B2 | 1/2017 | Kikuchi et al. |
| 9,551,947 | B2 | 1/2017 | Hiroko et al. |
| 9,551,949 | B2 | 1/2017 | Yamauchi et al. |
| 9,556,359 | B2 | 1/2017 | Suzumura et al. |
| 9,581,931 | B2 | 2/2017 | Yamada et al. |
| 9,599,913 | B2 | 3/2017 | Nishioka et al. |
| 9,639,009 | B2 | 5/2017 | Yamaguchi et al. |
| 9,651,888 | B2 | 5/2017 | Muranaka et al. |
| 9,665,028 | B2 | 5/2017 | Arimura et al. |
| 9,665,029 | B2 | 5/2017 | Hino et al. |
| 9,740,133 | B2 | 8/2017 | Yamauchi et al. |
| 9,811,009 | B2 | 11/2017 | Yamada et al. |
| 9,811,021 | B2 | 11/2017 | Muranaka et al. |
| 9,897,931 | B2 | 2/2018 | Nishioka et al. |
| 9,958,802 | B2 | 5/2018 | Kikuchi et al. |
| 9,964,874 | B2 | 5/2018 | Suzumura et al. |
| 9,964,881 | B2 | 5/2018 | Ikejiri et al. |
| 9,964,914 | B2 | 5/2018 | Arimura et al. |
| 9,977,353 | B2 | 5/2018 | Nishioka et al. |
| 10,018,927 | B2 | 7/2018 | Yamada et al. |
| 10,018,934 | B2 | 7/2018 | Yamada et al. |
| 10,108,129 | B2 | 10/2018 | Yamaguchi et al. |
| 10,280,148 | B2 | 5/2019 | Nishioka et al. |
| 10,416,588 | B2 | 9/2019 | Masu et al. |
| 10,488,777 | B2 | 11/2019 | Terauchi et al. |
| 10,649,350 | B2 | 5/2020 | Yamaguchi et al. |
| 10,678,154 | B2 | 6/2020 | Takashima et al. |
| 10,678,158 | B2 | 6/2020 | Kikuchi et al. |
| 11,061,342 | B2 * | 7/2021 | Umeda ..... G03G 5/0553 |
| 11,112,719 | B2 * | 9/2021 | Makisumi ..... G03G 21/1814 |
| 11,137,716 | B2 * | 10/2021 | Hiyama ..... G03G 5/0596 |
| 2012/0251171 | A1 | 10/2012 | Muranaka et al. |
| 2012/0308261 | A1 | 12/2012 | Tsuru et al. |
| 2013/0281276 | A1 | 10/2013 | Watanabe et al. |
| 2014/0072343 | A1 | 3/2014 | Masu et al. |
| 2014/0080691 | A1 | 3/2014 | Kurachi et al. |
| 2014/0255838 | A1 * | 9/2014 | Matsuda ..... G03G 21/1814 399/176 |
| 2015/0331346 | A1 | 11/2015 | Yamauchi et al. |
| 2017/0336727 | A1 * | 11/2017 | Ikejiri ..... G03G 9/0821 |
| 2019/0064686 | A1 * | 2/2019 | Terauchi ..... G03G 9/09708 |
| 2020/0150552 | A1 * | 5/2020 | Shindo ..... G03G 15/0233 |
| 2020/0225593 | A1 | 7/2020 | Yamaguchi et al. |
| 2020/0310264 | A1 | 10/2020 | Kurachi et al. |
| 2020/0310265 | A1 | 10/2020 | Nishioka et al. |
| 2020/0310266 | A1 | 10/2020 | Kikuchi et al. |
| 2020/0392306 | A1 * | 12/2020 | Lee ..... C08F 222/104 |
| 2021/0026295 | A1 | 1/2021 | Yamada et al. |
| 2021/0033996 | A1 | 2/2021 | Kikuchi et al. |
| 2021/0116826 | A1 * | 4/2021 | Nishida ..... G03G 5/14704 |
| 2021/0116827 | A1 * | 4/2021 | Fukudome ..... G03G 15/0233 |
| 2021/0116829 | A1 * | 4/2021 | Tomono ..... C08K 3/26 |
| 2021/0116831 | A1 * | 4/2021 | Tominaga ..... G03G 9/08711 |
| 2021/0116832 | A1 * | 4/2021 | Kototani ..... G03G 9/0819 |
| 2021/0116833 | A1 * | 4/2021 | Ishiduka ..... G03G 5/14791 |
| 2021/0116856 | A1 * | 4/2021 | Mukai ..... G03G 9/0825 |
| 2021/0116858 | A1 * | 4/2021 | Watariguchi ..... G03G 5/05 |
| 2021/0116859 | A1 * | 4/2021 | Unno ..... G03G 15/0233 |
| 2021/0116860 | A1 * | 4/2021 | Suzumura ..... G03G 9/08795 |

FOREIGN PATENT DOCUMENTS

| | | | |
|---|---|---|---|
| JP | 2003280246 | A | 10/2003 |
| JP | 2003323095 | A * | 11/2003 |
| JP | 2005049630 | A | 2/2005 |
| JP | 2012068623 | A | 4/2012 |
| JP | 2017107169 | A | 6/2017 |
| JP | 2017198929 | A * | 11/2017 |
| JP | 2017207680 | A | 11/2017 |
| JP | 2017211648 | A | 11/2017 |
| JP | 2018077385 | A | 5/2018 |
| JP | 2019045578 | A | 3/2019 |

OTHER PUBLICATIONS

U.S. Appl. No. 17/069,919, Tsutomu Nishida, filed Oct. 14, 2020.
U.S. Appl. No. 17/070,054, Yuka Ishiduka, filed Oct. 14, 2020.
U.S. Appl. No. 17/070,085, Fumiyuki Hiyama, filed Oct. 14, 2020.
U.S. Appl. No. 17/070,179, Kaname Watariguchi, filed Oct. 14, 2020.
U.S. Appl. No. 17/071,103, Noriyoshi Umeda, filed Oct. 15, 2020.
U.S. Appl. No. 17/071,109, Shohei Kototani, filed Oct. 15, 2020.
U.S. Appl. No. 17/071,227, Kosuke Fukudome, filed Oct. 15, 2020.
U.S. Appl. No. 17/071,246, Tomohiro Unno, filed Oct. 15, 2020.
U.S. Appl. No. 17/071,283, Yoshitaka Suzumura, filed Oct. 15, 2020.
U.S. Appl. No. 17/071,535, Hiroyuki Tomono, filed Oct. 15, 2020.
U.S. Appl. No. 17/072,206, Satoru Nishioka, filed Oct. 16, 2020.

* cited by examiner

ELECTROPHOTOGRAPHIC APPARATUS, PROCESS CARTRIDGE, AND CARTRIDGE SET

BACKGROUND OF THE INVENTION

Field of the Invention

The present disclosure is directed to an electrophotographic apparatus, a process cartridge, and a cartridge set.

Description of the Related Art

A stable image quality, even during continuous long-term use, has been required in recent years of electrophotographic apparatuses, e.g., copying machines and printers. A conductive member is used as the charging member in electrophotographic apparatuses. A structure having a conductive support and a conductive layer disposed on the support is known for the conductive member. The conductive member functions to transport charge from the conductive support to the surface of the conductive member and to impart charge to an abutting object through electrical discharge or triboelectric charging.

In its role as a charging member, the conductive member is a member that causes the generation of an electrical discharge with the electrophotographic photosensitive member and charges the surface of the electrophotographic photosensitive member.

Japanese Patent Application Laid-open No. 2002-3651 describes a charging member that has a uniform electrical resistance and that exhibits electrical characteristics that are stable with elapsed time and are not influenced by changes in the environment, e.g., temperature, humidity, and so forth.

Japanese Patent Application Laid-open No. 2019-45578 proposes a toner including fine particles of a titanate salt as an external additive for providing improvement from the toner side.

SUMMARY OF THE INVENTION

It has been found that when an electrophotographic apparatus is subjected to long-term, continuous use, a blurriness in the electrostatic latent image, known as "image smearing", is produced in particular in high-temperature, high-humidity environments.

The production of this image smearing is thought to proceed as follows. Electrical discharge products, e.g., ozone, $NO_x$, and so forth, are produced by the charging member and attach to the surface of the photosensitive member. These electrical discharge products attached to the surface of the photosensitive member absorb moisture in a high-humidity environment, and the surface of the photosensitive member then undergoes a decline in resistance. This results in the production of blurriness in the electrostatic latent image due to a reduction in the charge retention capability of the photosensitive member. This is thought to be the process by which image smearing is produced.

It was found that both the charging member according to Japanese Patent Application Laid-open No. 2002-3651 and the toner according to Japanese Patent Application Laid-open No. 2019-45578 are excellent from the standpoint of the image quality during long-term continuous use, but that there is room for improvement with regard to high-temperature, high-humidity environments.

The present disclosure is directed to providing an electrophotographic apparatus, process cartridge, and cartridge set that can suppress image smearing and can form high-quality electrophotographic images, even in high-speed image-forming processes in high-temperature, high-humidity environments.

One aspect of the present disclosure provides an electrophotographic apparatus comprising:

an electrophotographic photosensitive member, a charging unit for charging a surface of the electrophotographic photosensitive member, and a developing unit for developing an electrostatic latent image formed on the surface of the electrophotographic photosensitive member with a toner to form a toner image on the surface of the electrophotographic photosensitive member, wherein the charging unit comprises a conductive member disposed to be contactable with the electrophotographic photosensitive member;

the conductive member comprises a support having a conductive outer surface and a conductive layer disposed on the outer surface of the support;

the conductive layer comprises a matrix and a plurality of domains dispersed in the matrix;

the matrix contains a first rubber;

each of the domains contains a second rubber and an electronic conducting agent;

at least some of the domains are exposed at an outer surface of the conductive member;

the outer surface of the conductive member is constituted of at least the matrix and the domains that are exposed at the outer surface of the conductive member;

the matrix has a volume resistivity R1 of larger than $1.00\times10^{12}$ Ω·cm and not larger than $1.00\times10^{17}$ Ω·cm;

the volume resistivity R1 of the matrix is at least $1.0\times10^{5}$-times a volume resistivity R2 of the domains;

the developing unit comprises the toner;

the toner comprises a toner particle containing a binder resin, and an external additive; and the external additive contains a fine particle of a hydrotalcite compound.

Another aspect of the present disclosure provides a process cartridge detachably provided to a main body of an electrophotographic apparatus, the process cartridge comprising a charging unit for charging a surface of an electrophotographic photosensitive member, and a developing unit for developing an electrostatic latent image formed on the surface of the electrophotographic photosensitive member with a toner to form a toner image on the surface of the electrophotographic photosensitive member, wherein the charging unit comprises a conductive member disposed to be contactable with the electrophotographic photosensitive member;

the conductive member comprises a support having a conductive outer surface and a conductive layer disposed on the outer surface of the support;

the conductive layer comprises a matrix and a plurality of domains dispersed in the matrix;

the matrix contains a first rubber;

each of the domains contains a second rubber and an electronic conducting agent;

at least some of the domains are exposed at an outer surface of the conductive member;

the outer surface of the conductive member is constituted of at least the matrix and the domains that are exposed at the outer surface of the conductive member;

the matrix has a volume resistivity R1 of larger than $1.00\times10^{12}$ Ω·cm and not larger than $1.00\times10^{17}$ Ω·cm;

the volume resistivity R1 of the matrix is at least $1.0\times10^{5}$-times a volume resistivity R2 of the domains;

the developing unit comprises the toner;

the toner comprises a toner particle containing a binder resin, and an external additive; and the external additive contains a fine particle of a hydrotalcite compound.

Another aspect of the present disclosure provides a cartridge set comprising a first cartridge and a second cartridge detachably provided to a main body of an electrophotographic apparatus, wherein the first cartridge includes a charging unit for charging a surface of an electrophotographic photosensitive member and a first frame for supporting the charging unit;

the second cartridge includes a toner container that holds a toner for forming a toner image on the surface of the electrophotographic photosensitive member by developing an electrostatic latent image formed on the surface of the electrophotographic photosensitive member;

the charging unit comprises a conductive member disposed to be contactable with the electrophotographic photosensitive member;

the conductive member comprises a support having a conductive outer surface and a conductive layer disposed on the outer surface of the support;

the conductive layer comprises a matrix and a plurality of domains dispersed in the matrix;

the matrix contains a first rubber;

each of the domains contains a second rubber and an electronic conducting agent;

at least some of the domains are exposed at an outer surface of the conductive member;

the outer surface of the conductive member is constituted of at least the matrix and the domains that are exposed at the outer surface of the conductive member;

the matrix has a volume resistivity R1 of larger than $1.00\times10^{12}$ Ω·cm and not larger than $1.00\times10^{17}$ Ω·cm;

the volume resistivity R1 of the matrix is at least $1.0\times10^{5}$-times a volume resistivity R2 of the domains;

the toner comprises a toner particle containing a binder resin, and an external additive; and the external additive contains a fine particle of a hydrotalcite compound.

The present disclosure can provide an electrophotographic apparatus, process cartridge, and cartridge set that can suppress image smearing and can form high-quality electrophotographic images, even in high-speed image-forming processes in high-temperature, high-humidity environments.

Further features of the present invention will become apparent from the following description of exemplary embodiments with reference to the attached drawings.

DESCRIPTION OF THE EMBODIMENTS

Figure 1:
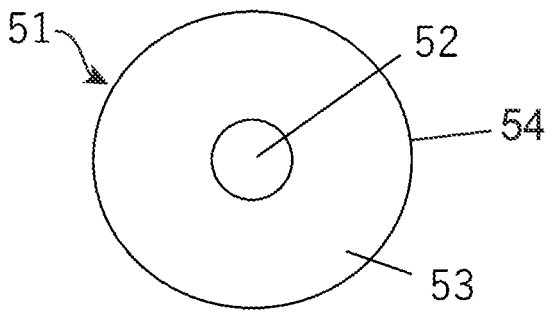
FIG. 1 is a cross-sectional diagram of a charging roller for the direction orthogonal to the longitudinal direction.

Unless specifically indicated otherwise, the expressions "from XX to YY" and "XX to YY" that show numerical value ranges refer to numerical value ranges that include the lower limit and upper limit that are the end points.

When numerical value ranges are provided in stages, the upper limits and lower limits of the individual numerical value ranges may be combined in any combination.

The present inventors discovered that, by combining the toner and conductive member described in the following, image smearing can be suppressed during high-speed processes and during long-term repetitive use conditions, in particular in high-temperature, high-humidity environments.

The toner includes a binder resin-containing toner particle and an external additive, and the external additive contains fine particles of a hydrotalcite compound.

The conductive member includes a support having a conductive outer surface and a conductive layer disposed on the outer surface of the support, and is disposed to be contactable with the electrophotographic photosensitive member;

the conductive layer includes a matrix and a plurality of domains dispersed in the matrix;

the matrix contains a first rubber;

each of the domains contains a second rubber and an electronic conducting agent;

at least some of the domains are exposed at an outer surface of the conductive member;

the outer surface of the conductive member is constituted of at least the matrix and the domains that are exposed at the outer surface of the conductive member;

a volume resistivity R1 of the matrix is greater than $1.00\times10^{12}$ Ω·cm and not greater than $1.00\times10^{17}$ Ω·cm; and using R2 for a volume resistivity of the domains, the volume resistivity R1 of the matrix is at least $1.0\times10^{5}$-times the volume resistivity R2 of the domains.

The outer surface of the conductive member is the surface of the conductive member in contact with the toner.

The present inventors hypothesize the following with regard to the mechanism by which this image smearing is suppressed.

First, hydrotalcite compound fine particles transferred from the toner bind onto the domains at the surface of the conductive layer of the conductive member. The reason for this is as follows.

The domains contain an electronic conducting agent, which as a result facilitates the assumption of a low volume resistivity. When the photosensitive member is negatively charged, the surface of the conductive member maintains a large amount of negative charge. Since the surface of the conductive member has a matrix-domain structure and since the volume resistivity R1 of the matrix is at least $1.0\times10^{5}$-times the volume resistivity R2 of the domains, the negative charge is thought to concentrate at the domains.

Hydrotalcite compounds are positively charged and due to this are thought to electrostatically bind to the domains. The hydrotalcite compound bound to the domains adsorbs the nitrogen oxide ($NO_x$) produced by the electrophotographic process step. Due to this, the reaction on the drum of nitrogen oxide with moisture to give nitric acid can be prevented and image smearing can be suppressed. The hydrotalcite compound selectively binds to the domains and due to this efficiently adsorbs the nitrogen oxide even when the hydrotalcite compound is present in small amounts.

The conductive member in its role as a charging member and the toner will be described in view of the mechanism given in the preceding.

Description of the Conductive Member (Charging Member)

The conductive member, when used as a charging member, is able to continuously apply an electrical discharge at a stable level to the electrophotographic photosensitive member. Due to this, a stable electrical discharge can be produced even in a high-temperature, high-humidity environment, and as a consequence the generation of an excess electrical discharge versus the electrophotographic photosensitive member does not occur. It is thought that as a result potential formation is made possible at a minimum amount of electrical discharge and the amount of production of electrical discharge products can be restrained.

The present inventors hypothesize the following as to why a conductive member provided with the above-described structure is able to continuously apply an electrical discharge at a stable level to the article to be charged and is able to suppress an excess electrical discharge.

When a charging bias is applied between the support in the conductive member and the electrophotographic photosensitive member, it is thought that within the conductive layer the charge migrates, proceeding as described in the following, to the side of the conductive layer opposite from the support side, i.e., to the outer surface side of the conductive member. That is, the charge accumulates in the neighborhood of the matrix/domain interface.

In addition, this charge successively transfers from the domains located on the side of the conductive support to the domains on the side opposite from the side of the conductive support, to reach the conductive layer surface (also referred to hereafter as the "outer surface of the conductive layer") on the side opposite from the side of the conductive support. When this occurs, and when, in a first charging process, the charge on all the domains has transferred to the outer surface side of the conductive layer, time is required for charge to accumulate in the conductive layer for the next charging process. It is thus difficult for a stable electrical discharge to be achieved in a high-speed electrophotographic image-forming process.

Accordingly, even when a charging bias has been applied, preferably charge transfer between domains does not occur simultaneously. In addition, since, in a high-speed electrophotographic image-forming process, charge movement is limited, preferably a satisfactory amount of charge is accumulated at each domain to bring about the discharge of a satisfactory amount of charge in a single electrical discharge.

The conductive layer includes a matrix and a plurality of domains dispersed in the matrix. In addition, the matrix contains a first rubber and the domains contain a second rubber and an electronic conducting agent. The matrix and the domains satisfy the following component factor (i) and component factor (ii).

component factor (i): The volume resistivity R1 of the matrix is greater than $1.00\times10^{12}$ Ω·cm and is not greater than $1.00\times10^{17}$ Ω·cm.

component factor (ii): The matrix volume resistivity R1 is at least $1.0\times10^{5}$-times the volume resistivity R2 of the domains.

A conductive member provided with a conductive layer that satisfies component factors (i) and (ii) can accumulate satisfactory charge at the individual domains when a bias is applied with the photosensitive member. In addition, since the domains are divided from each other by the electrically insulating matrix, simultaneous charge transfer between domains can be inhibited. As a consequence of this, the discharge in a single electrical discharge of the majority of the charge accumulated within the conductive layer can be prevented.

As a result, a state can be set up within the conductive layer in which, even directly after the completion of a first electrical discharge, charge for the next electrical discharge is still accumulated. Due to this, a stable electrical discharge can be produced on a short cycle. Such an electrical discharge achieved by the conductive member according to the present disclosure is also referred to as a "microdischarge" in the following.

As described in the preceding, the conductive layer provided with a matrix-domain structure that satisfies component factors (i) and (ii) can suppress the occurrence of simultaneous charge transfer between domains when a bias is applied and can bring about the accumulation of satisfactory charge within the domains. As a consequence, this conductive member, even when deployed in an electrophotographic image-forming apparatus having a fast process speed, can continuously impart a stable charge to an article to be charged, can suppress excessive electric discharge, and can suppress the amount of production of electrical discharge products.

A conductive member having a roller configuration (also referred to hereinbelow as a "conductive roller") will be described with reference to FIG. 1 as an example of the conductive member. FIG. 1 is a diagram of a cross section orthogonal to the direction along the axis of the conductive roller (also referred to hereinbelow as the "longitudinal direction"). The conductive roller 51 has a cylindrical conductive support 52 and has a conductive layer 53 formed on the circumference of the support 52, i.e., on the outer surface 54 of the support.

The Support

The material constituting the support can be a suitable selection from materials known in the field of conductive members for electrophotographic applications and materials that can be utilized as a conductive member. Examples here are metals and alloys such as aluminum, stainless steel, conductive synthetic resins, iron, copper alloys, and so forth.

An oxidation treatment or a plating treatment, e.g., with chromium, nickel, and so forth, may be executed on the preceding. Electroplating or electroless plating may be used as the plating mode. Electroless plating is preferred from the standpoint of dimensional stability. The type of electroless plating used here can be exemplified by nickel plating, copper plating, gold plating, and plating with various alloys.

The plating thickness is preferably at least 0.05 μm, and a plating thickness from 0.10 μm to 30.00 μm is preferred based on a consideration of the balance between production efficiency and anti-corrosion performance. The cylindrical shape of the support may be a solid cylindrical shape or a hollow cylindrical shape (tubular shape). The outer diameter of the support is preferably in the range from 3 mm to 10 mm.

When a medium-resistance layer or insulating layer is present between the support and the conductive layer, it may then not be possible to rapidly supply charge after charge has been consumed by electrical discharge. Thus, preferably either the conductive layer is directly disposed on the support or the conductive layer is disposed on the outer periphery of the support with only an interposed intermediate layer including a conductive thin-film resin layer, e.g., a primer.

A selection from known primers, in conformity with, e.g., the material of the support and the rubber material used to form the conductive layer, can be used as this primer. The material of the primer can be exemplified by thermosetting resins and thermoplastic resins, and known materials such as phenolic resins, urethane resins, acrylic resins, polyester resins, polyether resins, and epoxy resins can specifically be used.

The Conductive Layer

The conductive layer includes a matrix and a plurality of domains dispersed in the matrix. In addition, the matrix contains a first rubber and the domains contain a second rubber and an electronic conducting agent. The matrix and the domains satisfy the following component factors (i) and (ii).

component factor (i): The volume resistivity R1 of the matrix is greater than $1.00\times10^{12}$ Ω·cm and not greater than $1.00\times10^{17}$ Ω·cm.

component factor (ii): The matrix volume resistivity R1 is at least $1.0\times10^{5}$-times the volume resistivity R2 of the domains.

Component Factor (i): Matrix Volume Resistivity

By having the volume resistivity R1 of the matrix be greater than $1.00\times10^{12}$ Ω·cm, the movement of charge in the matrix while circumventing the domains can be suppressed. In addition, consumption of the majority of accumulated charge by a single electrical discharge can be suppressed. Moreover, this can prevent the charge accumulated in the domains, through its leakage into the matrix, from providing a condition as if conduction pathways that communicate within the conduction layer were to be formed.

The volume resistivity R1 is preferably at least $2.00\times10^{12}$ Ω·cm.

The upper limit on R1 is not more than $1.00\times10^{17}$ Ω·cm. Not more than $9.00\times10^{16}$ Ω·cm is preferred.

The present inventors believe that a structure in which regions where charge is satisfactorily accumulated (domains) are partitioned off by an electrically insulating region (matrix), is effective for bringing about charge transfer via the domains in the conductive layer and achieving microdischarge. In addition, by having the matrix volume resistivity be in the range of a high-resistance region as indicated above, adequate charge can be kept at the interface with each domain and charge leakage from the domains can also be suppressed.

In addition, in order for the electrical discharge to achieve a level of electrical discharge that is necessary and sufficient and a microdischarge, it is very effective to limit the charge transfer pathways to domain-mediated pathways. By suppressing charge leakage from the domains into the matrix and limiting the charge transport pathways to pathways that proceed via a plurality of domains, the density of the charge present on the domains can be boosted and due to this the amount of charge loaded at each domain can be further increased.

It is thought that this supports an increase, at the surface of the domains in their role as a conductive phase that is the source of the electrical discharge, in the overall charge population able to participate in electrical discharge, and that as a result the ease of electrical discharge elaboration from the surface of the conductive member can be enhanced.

Method for Measuring the Volume Resistivity of the Matrix:

The volume resistivity of the matrix can be measured with microprobes on thin sections prepared from the conductive layer. A means that can produce a very thin sample, such as a microtome, can be used as the means for preparing the thin sections. The specific procedure is described below.

Component Factor (ii): Domain Volume Resistivity

The matrix volume resistivity R1 is at least $1.0\times10^{5}$-times the volume resistivity R2 of the domains.

This facilitates restricting the charge transport pathways to pathways via a plurality of domains, while suppressing unwanted charge transport by the matrix.

R1 is more preferably from $1.0\times10^{5}$-times to $1.0\times10^{20}$-times R2, still more preferably from $1.0\times10^{6}$-times to $1.0\times10^{18}$-times R2, and even more preferably $1.0\times10^{11}$-times to $1.0\times10^{16}$-times R2.

In addition, R2 is preferably from $1.00\times10^{1}$ Ω·cm to $1.00\times10^{4}$ Ω·cm and more preferably from $1.00\times10^{1}$ Ω·cm to $1.00\times10^{2}$ Ω·cm.

By satisfying the preceding, the charge transport paths within the conductive layer can be controlled and a microdischarge is more easily achieved. Due to this, excessive electrical discharge can be suppressed and image smearing can be suppressed.

The volume resistivity of the domains is adjusted, for example, by bringing the conductivity of the rubber component of the domains to a prescribed value by changing the type and amount of the electronic conducting agent.

A rubber composition containing a rubber component for use for the matrix can be used as the rubber material for the domains. In order to form a matrix-domain structure, the difference in the solubility parameter (SP value) from the rubber material forming the matrix is preferably brought into a prescribed range. That is, the absolute value of the difference between the SP value of the first rubber and the SP value of the second rubber is preferably from 0.4 $(J/cm^3)^{0.5}$ to 5.0 $(J/cm^3)^{0.5}$ and more preferably from 0.4 $(J/cm^3)^{0.5}$ to 2.2 $(J/cm^3)^{0.5}$ The domain volume resistivity can be adjusted through judicious selection of the type of electronic conducting agent and its amount of addition. With regard to the electronic conducting agent used to control the domain volume resistivity to from $1.00\times10^{1}$ Ω·cm to $1.00\times10^{4}$ Ω·cm, preferred electronic conducting agents are those that can bring about large variations in the volume resistivity, from a high resistance to a low resistance, as a function of the amount that is dispersed.

The electronic conducting agent blended in the domains can be exemplified by carbon black; graphite; oxides such as titanium oxide, tin oxide, and so forth; metals such as Cu, Ag, and so forth; and particles rendered conductive by coating the surface with an oxide or metal. As necessary, a blend of suitable quantities of two or more of these conducting agents may be used.

Among these electronic conducting agents, the use is preferred of conductive carbon black, which has a high affinity for rubber and supports facile control of the electronic conducting agent-to-electronic conducting agent distance. There are no particular limits on the type of carbon black blended into the domains. Specific examples are gas furnace black, oil furnace black, thermal black, lamp black, acetylene black, and Ketjenblack.

Among the preceding, a conductive carbon black having a DBP absorption from 40 $cm^3$/100 g to 170 $cm^3$/100 g, which can impart a high conductivity to the domains, can be favorably used.

The content of the electronic conducting agent, e.g., conductive carbon black, is preferably from 20 mass parts to 150 mass parts per 100 mass parts of the second rubber contained in the domains. From 50 mass parts to 100 mass parts is more preferred.

The conducting agent is preferably blended in larger amounts than for ordinary electrophotographic conductive members. Doing this makes it possible to easily control the volume resistivity of the domains into the range from $1.00\times10^{1}$ Ω·cm to $1.00\times10^{4}$ Ω·cm.

The fillers, processing aids, co-crosslinking agents, crosslinking accelerators, ageing inhibitors, crosslinking co-accelerators, crosslinking retarders, softeners, dispersing agents, colorants, and so forth that are ordinarily used as rubber blending agents may as necessary be added to the rubber composition for the domains within a range in which the effects according to the present disclosure are not impaired.

Method for Measuring the Volume Resistivity of the Domains:

Measurement of the volume resistivity of the domains may be carried out using the same method as the method for measuring the volume resistivity of the matrix, but changing the measurement location to a location corresponding to a domain and changing the voltage applied during measurement of the current value to 1 V. The specific procedure is described below.

Component Factor (iii): Distance Between Adjacent Walls of the Domains>

From the standpoint of bringing about charge transfer between domains, the arithmetic-mean value Dm of the distance between adjacent walls of the domains (also referred to herebelow simply as the "interdomain distance Dm"), in observation of the cross section in the thickness direction of the conductive layer, is preferably not more than 2.00 μm and more preferably not more than 1.00 μm.

In addition, in order for the domains to be securely electrically partitioned from one another by an insulating region (matrix) and enable charge to be readily accumulated by the domains, the interdomain distance Dm is preferably at least 0.15 μm and more preferably at least 0.20 μm.

Method for Measuring the Interdomain Distance Dm:

Measurement of the interdomain distance Dm may be carried out using the following method.

First, a section is prepared using the same method as the method used in measurement of the volume resistivity of the matrix, supra. In order to favorably carry out observation of the matrix-domain structure, a pretreatment that provides good contrast between the conductive phase and insulating phase may be carried out, e.g., a staining treatment, vapor deposition treatment, and so forth.

The presence of a matrix-domain structure is checked by observation using a scanning electron microscope (SEM) of the section after formation of a fracture surface and platinum vapor deposition. The SEM observation is preferably carried out at 5,000× from the standpoint of the accuracy of quantification of the domain area. The specific procedure is described below.

Uniformity of the Interdomain Distance Dm:

The interdomain distance Dm preferably has a uniform distribution in order to enable the formation of a more stable microdischarge. Having a uniform distribution for the interdomain distance Dm makes it possible to reduce phenomena that impair the ease of electrical discharge elaboration, e.g., the occurrence of locations where charge supply is delayed relative to the surroundings due to the presence to some degree of locations within the conductive layer where the interdomain distance is locally longer.

Figure 3A:
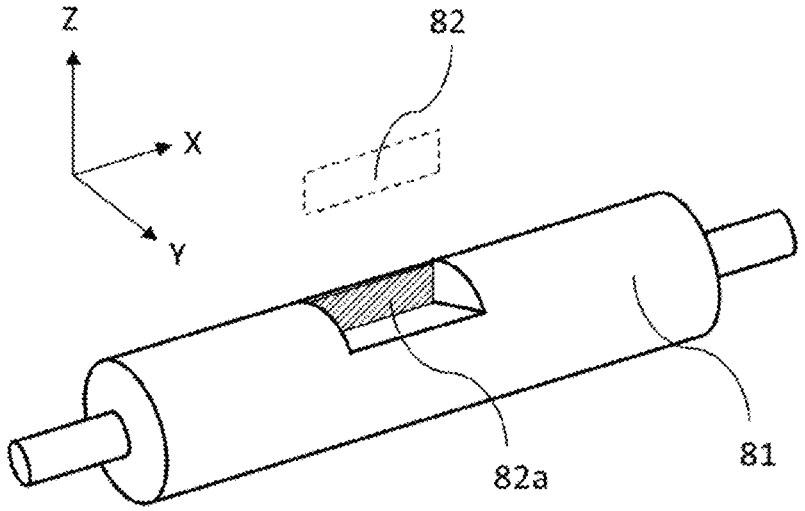
FIGS. 3A and 3B are explanatory diagrams of a charging roller for the direction of cross section excision from the conductive layer.
Figure 3B:
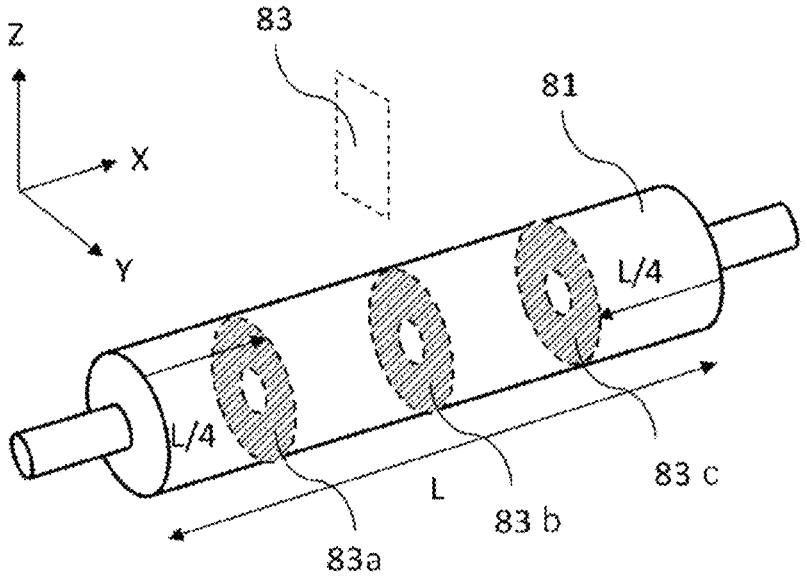

Operating in the charge transport cross section, i.e., the cross section in the thickness direction of the conductive layer as shown in FIG. 3B, a 50 μm-square region of observation is taken at three randomly selected locations in the thickness region at a depth of 0.1 T to 0.9 T from the outer surface of the conductive layer in the direction of the support. In this case, and using the interdomain distance Dm within these regions of observation and the standard deviation σm of the distribution of the interdomain distance, the variation coefficient σm/Dm for the interdomain distance is preferably from 0 to 0.40 and is more preferably from 0.10 to 0.30.

Method for Measuring the Uniformity of the Interdomain Distance Dm:

The uniformity of the interdomain distance can be measured by quantification of the image obtained by direct observation of the fracture surface as in the measurement of the interdomain distance. The specific procedure is described below.

The conductive member can be formed, for example, via a method including the following steps (i) to (iv):

step (i): a step of preparing a domain-forming rubber mixture (also referred to hereafter as "CMB") containing carbon black and a second rubber;

step (ii): a step of preparing a matrix-forming rubber mixture (also referred to hereafter as "MRC") containing a first rubber;

step (iii): a step of preparing a rubber mixture having a matrix-domain structure by kneading the CMB with the MRC; and step (iv): a step of forming a conductive layer by forming a layer of the rubber mixture prepared in step (iii) on a conductive support, either directly thereon or via another layer, and curing the rubber mixture layer.

Component factors (i) to (iii) can be controlled, for example, through the selection of the materials used in the individual steps described above and through adjustment of the production conditions. This is described in the following.

First, with regard to component factor (i), the volume resistivity of the matrix is governed by the composition of the MRC.

Low-conductivity rubbers are preferred for the first rubber that is used in the MRC. At least one selection from the group consisting of natural rubber, butadiene rubber, butyl rubber, acrylonitrile-butadiene rubber, urethane rubber, silicone rubber, fluorocarbon rubber, isoprene rubber, chloroprene rubber, styrene-butadiene rubber, ethylene-propylene rubber, ethylene-propylene-diene rubber, and polynorbornene rubber is preferred.

The first rubber is more preferably at least one selection from the group consisting of butyl rubber, styrene-butadiene rubber, and ethylene-propylene-diene rubber.

The following may be added to the MRC on an optional basis as long as the volume resistivity of the matrix is in the range given above: fillers, processing aids, crosslinking agents, co-crosslinking agents, crosslinking accelerators, crosslinking co-accelerators, crosslinking retarders, ageing inhibitors, softeners, dispersing agents, colorants, and so forth. On the other hand, in order to bring the matrix volume resistivity into the range indicated above, an electronic conducting agent, e.g., carbon black, is preferably not incorporated in the MRC.

In relation to component factor (ii), the domain volume resistivity R2 can be adjusted using the amount of the electronic conducting agent in the CMB. For example, considering the example of the use as the electronic conducting agent of a conductive carbon black having a DBP absorption of from 40 $cm^3$/100 g to 170 $cm^3$/100 g, the desired range can be achieved by preparing a CMB that contains from 40 mass parts to 200 mass parts of the conductive carbon black per 100 mass parts of the second rubber in the CMB.

In addition, controlling the following (a) to (d) is effective with regard to the state of domain dispersion in relation to component factor (iii):

(a) the difference between the interfacial tensions a of the CMB and the MRC;

(b) the ratio between the viscosity of the MRC (ηm) and the viscosity of the CMB (ηd) (ηm/ηd);

(c) the shear rate (γ) and the amount of energy during shear (EDK) when the CMB and the MRC are kneaded in step (iii); and (d) the volume fraction of the CMB relative to the MRC in step (iii).

(a) The Difference in Interfacial Tension Between the CMB and the MRC

Phase separation generally occurs when two species of incompatible rubbers are mixed. This occurs because the interaction between the same species of polymer molecules is stronger than the interaction between different species of polymer molecules, resulting in aggregation between the same species of polymer molecules, a reduction in free energy, and stabilization.

The interface in a phase-separated structure, due to contact with a different species of polymer molecules, assumes a higher free energy than the interior, which is stabilized by the interaction between polymer molecules of the same species. As a result, in order to lower the interfacial free energy, an interfacial tension occurs directed to reducing the area of contact with the different species of polymer molecules. When this interfacial tension is small, this moves in the direction of a more uniform mixing, even by different species of polymer molecules, to increase the entropy. A uniformly mixed state is dissolution, and there is a tendency for the interfacial tension to correlate with the SP value (solubility parameter), which is a metric for solubility.

Thus, the difference in interfacial tension between the CMB and the MRC is thought to correlate with the difference in the SP values of the rubbers contained by each. Rubbers are preferably selected whereby the absolute value of the difference between the solubility parameter SP value of the first rubber in the MRC and the SP value of the second rubber in the CMB is preferably from 0.4 $(J/cm^3)^{0.5}$ to 5.0 $(J/cm^3)^{0.5}$ and is more preferably from 0.4 $(J/cm^3)^{0.5}$ to 2.2 $(J/cm^3)^{0.5}$. Within this range, a stable phase-separated structure can be formed and a small CMB domain diameter can be established.

Specific preferred examples of second rubbers that can be used in the CMB here are, for example, at least one selection from the group consisting of natural rubber (NR), isoprene rubber (IR), butadiene rubber (BR), acrylonitrile-butadiene rubber (NBR), styrene-butadiene rubber (SBR), butyl rubber (IIR), ethylene-propylene rubber (EPM), ethylene-propylene-diene rubber (EPDM), chloroprene rubber (CR), nitrile rubber (NBR), hydrogenated nitrile rubber (H-NBR), silicone rubber, and urethane rubber (U).

The second rubber is more preferably at least one selection from the group consisting of butadiene rubber (BR), styrene-butadiene rubber (SBR), butyl rubber (IIR), and acrylonitrile-butadiene rubber (NBR) and is still more preferably at least one selection from the group consisting of butadiene rubber (BR), styrene-butadiene rubber (SBR), and butyl rubber (IIR). At least one selection from the group consisting of butadiene rubber (BR) and butyl rubber (IIR) is even more preferred.

The thickness of the conductive layer is not particularly limited as long as the desired functions and effects are obtained for the conductive member. The thickness of the conductive layer is preferably from 1.0 mm to 4.5 mm.

The mass ratio between the domains and the matrix (domain:matrix) is preferably 5:95 to 40:60, more preferably 10:90 to 30:70, and still more preferably 13:87 to 25:75.

Method for Measuring the SP Value

The SP value can be determined with good accuracy by constructing a calibration curve using materials having already known SP values. Catalogue values provided by the material manufacturers may also be used as these already known SP values. For example, for NBR and SBR, the SP value is almost entirely determined by the content ratio for the acrylonitrile and styrene independently of the molecular weight.

Accordingly, the content ratio for acrylonitrile or styrene for the rubber constituting the matrix and domains is analyzed using an analytic procedure, e.g., pyrolysis gas chromatography (Py-GC) and solid-state NMR. By doing this, the SP value can be determined from a calibration curve obtained from materials for which the SP value is already known.

In addition, with an isoprene rubber, the SP value is governed by the isomer structure, e.g., 1,2-polyisoprene, 1,3-polyisoprene, 3,4-polyisoprene, cis-1,4-polyisoprene, trans-1,4-polyisoprene, and so forth. Thus, the isomer content ratio is analyzed using, e.g., Py-GC and solid-state NMR, as for SBR and NBR and the SP value can be determined from materials for which the SP value is already known.

The SP values of materials having already known SP values are determined using the Hansen sphere method.

(b) Viscosity Ratio Between the CMB and the MRC

The domain diameter declines as the viscosity ratio between the CMB and the MRC (CMB/MRC) (ηd/ηm) approaches 1. Specifically, this viscosity ratio is preferably from 1.0 to 2.0. The viscosity ratio between the CMB and the MRC can be adjusted through selection of the Mooney viscosity of the starting rubbers used for the CMB and the MRC and through the filler type and its amount of incorporation.

A plasticizer, e.g., paraffin oil, may also be added to the extent this does not hinder the formation of a phase-separated structure. The viscosity ratio may also be adjusted by adjusting the temperature during kneading.

The viscosity of the rubber mixture for domain formation and the viscosity of the rubber mixture for matrix formation are obtained by measurement of the Mooney viscosity $ML_{(1+4)}$ based on JIS K 6300-1: 2013; the measurement is performed at the temperature of the rubber during kneading.

(c) The Shear Rate and the Amount of Energy During Shear when the CMB is Kneaded with the MRC The interdomain distance Dm becomes smaller as the shear rate during kneading of the CMB with the MRC becomes faster and as the amount of energy during shear becomes larger.

The shear rate can be increased by increasing the inner diameter of the stirring members of the kneader, i.e., the blades and screw, to reduce the gap between the end face of the stirring members and the inner wall of the kneader, and by raising the rotation rate. An increase in the energy during shear can be achieved by raising the rotation rate of the stirring members and raising the viscosity of the first rubber in the CMB and the second rubber in the MRC.

(d) Volume Fraction of the CMB Relative to the MRC

The volume fraction of the CMB relative to the MRC correlates with the collisional coalescence probability for the domain-forming rubber mixture relative to the matrix-forming rubber mixture. Specifically, when the volume fraction of the domain-forming rubber mixture relative to the matrix-forming rubber mixture is reduced, the collisional coalescence probability for the domain-forming rubber mixture and matrix-forming rubber mixture declines. Thus, the inter-domain distance Dm can be made smaller by lowering the volume fraction of the domains in the matrix in the range in which the required conductivity is obtained.

The volume ratio of the CMB relative to the MRC (that is, the volume ratio of the domains to the matrix) is preferably from 15% to 40%.

Using L for the length in the longitudinal direction of the conductive layer in the conductive member and using T for the thickness of this conductive layer, cross sections in the thickness direction of the conductive layer are acquired, as shown in FIG. 3B, at three locations, i.e., at the center in the longitudinal direction of the conductive layer and at L/4 toward the center from both ends of the conductive layer. The following are preferably satisfied at each of the thickness direction cross sections in the conductive layer.

At each of these cross sections, a 15 μm-square region of observation is set up at three randomly selected locations in the thickness region at a depth of 0.1 T to 0.9 T from the outer surface of the conductive layer, and preferably at least 80 number % of the domains observed at each of all nine regions of observation satisfies the following component factors (iv) and (v).

Component Factor (iv)

The percentage μr for the cross-sectional area of the electronic conducting agent present in a domain with respect to the cross-sectional area of the domain is at least 20%.

component factor (v)

A/B is from 1.00 to 1.10 where A is the periphery length of the domain and B is the envelope periphery length of the domain.

Component factors (iv) and (v) can be regarded as specifications related to domain shape. This "domain shape" is defined as the cross-sectional shape of the domain visualized in the cross section in the thickness direction of the conductive layer.

The domain shape is preferably a shape that lacks unevenness in its peripheral surface, i.e., is a shape approximating a sphere. Reducing the number of uneven structures associated with the shape can reduce nonuniformity of the electric field between domains, i.e., can reduce locations where electric field concentration is produced and can reduce the phenomenon of the occurrence of unwanted charge transport in the matrix.

The present inventors have found that the amount of electronic conducting agent contained in one domain exercises an effect on the external shape of that domain. That is, it was found that, as the amount of loading of one domain with the electronic conducting agent increases, the external shape of that domain becomes closer to that of a sphere. A larger number of near-spherical domains results in ever fewer concentration points for electron transfer between domains.

Moreover, according to investigations by the present inventors, a near-spherical shape is better assumed by domains for which the total percentage μr, with reference to the area of the cross section of one domain, for the cross-sectional area of the electronic conducting agent observed in that cross section is at least 20%.

As a result, an external shape can be assumed that can significantly relax the concentration of electron transfer between domains, and this is thus preferred. Specifically, the percentage μr, with reference to the area of the cross section of a domain, for the cross-sectional area of the electronic conducting agent present in that domain is preferably at least 20%. 25% to 30% is more preferred.

A satisfactory amount of charge supply is made possible, even in high-speed processes, by satisfying the aforementioned range.

The present inventors discovered that the following formula (5) is preferably satisfied in relation to a shape that lacks unevenness on the peripheral surface of the domain.

$$1.00 \leq A/B \leq 1.10 \quad (5)$$

(A: periphery length of domain, B: envelope periphery length of domain)

Figure 6:
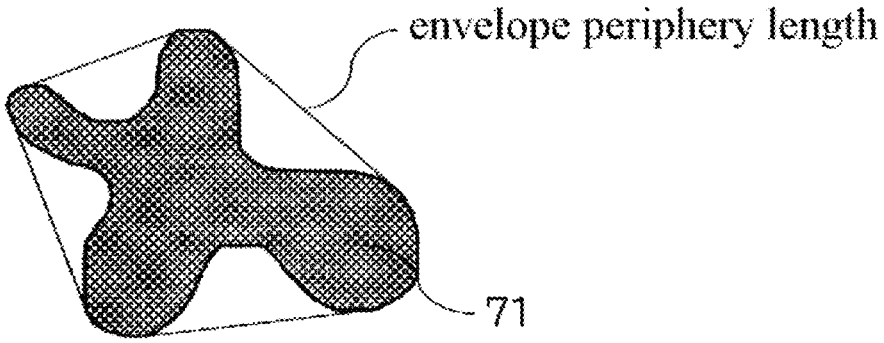
FIG. 6 is an explanatory diagram of the envelope periphery length of a domain.

Formula (5) indicates the ratio between the domain periphery length A and the domain envelope periphery length B. The envelope periphery length here is the periphery length, as shown in FIG. 6, when the protruded portions of a domain 71 observed in a region of observation are connected.

The ratio between the domain periphery length and domain envelope periphery length has a minimum value of 1, and a value of 1 indicates that the domain has a shape that lacks depressed portions in its cross-sectional shape, e.g., a perfect circle, ellipse, and so forth. When this ratio is equal to or less than 1.1, this indicates that large uneven shapes are not present in the domain and the expression of electric field anisotropy is suppressed.

Method for Measuring Each of the Parameters Related to Domain Shape

An ultrathin section having a thickness of 1 μm is sectioned out at an excision temperature of −100° C. from the conductive layer of the conductive member (conductive roller) using a microtome (product name: Leica EMFCS, Leica Microsystems GmbH). However, as indicated in the following, evaluation of the domain shape must be carried out on the fracture surface of a section prepared using a cross section orthogonal to the longitudinal direction of the conductive member. The reason for this is as follows.

FIG. 3A and FIG. 3B give diagrams that show the shape of a conductive member 81 using three axes and specifically the X, Y, and Z axes in three dimensions. The X axis in FIG. 3A and FIG. 3B shows the direction parallel to the longitudinal direction (axial direction) of the conductive member, and the Y axis and Z axis show the directions orthogonal to the axial direction of the conductive member.

FIG. 3A shows an image diagram for a conductive member, in which the conductive member has been cut out at a cross section 82*a* that is parallel to the XZ plane 82. The XZ plane can be rotated 360° centered on the axis of the conductive member. Considering that the conductive member rotates abutting a photosensitive drum and discharges upon the passage of a gap with the photosensitive drum, the cross section 82*a* parallel to the XZ plane 82 thus indicates a plane where discharge occurs simultaneously with a certain timing. The surface potential of the photosensitive drum is formed by the passage of a plane corresponding to a certain portion of the cross section 82*a*.

Accordingly, in order to evaluate the domain shape, which correlates with concentration of the electric field within the conductive member, rather than analysis of a cross section where discharge occurs simultaneously in a certain instant such as the cross section 82*a*, evaluation is required at a cross section parallel to the YZ plane 83 orthogonal to the axial direction of the conductive member, which enables evaluation of a domain shape that contains a certain portion of the cross section 82*a*.

Using L for the length of the conductive layer in the longitudinal direction, a total of three locations are selected for this evaluation, i.e., the cross section 83*b* at the center in the longitudinal direction of the conductive layer and cross sections (83*a* and 83*c*) at two positions that are L/4 toward the center from either end of the conductive layer.

In addition, in relation to the location of observation in cross sections 83*a* to 83*c* and using T for the thickness of the conductive layer, the measurement should be carried out at a total of nine regions of observation wherein a 15 μm-square region of observation is taken at three randomly selected locations in the thickness region at a depth of 0.1 T to 0.9 T from the outer surface of each section.

Vapor-deposited sections are obtained by executing platinum vapor deposition on the obtained sections. The surface of the vapor-deposited section is then magnified 1,000× or 5,000× using a scanning electron microscope (SEM) (product name: S-4800, Hitachi High-Technologies Corporation) and an observation image is acquired.

In order to quantify the domain shapes in this analysis image, a 256-gradation monochrome image is then obtained by carrying out 8-bit grey scale conversion using image processing software (product name: Image-Pro Plus, Media Cybernetics, Inc.). White/black reversal processing is subsequently carried out on the image so the domains in the fracture surface become white and a binarized image is obtained.

Method for Measuring the Cross-Sectional Area Percentage μr for the Electronic Conducting Agent in the Domain The cross-sectional area percentage for the electronic conducting agent in a domain can be measured by quantification of the binarized image of the aforementioned observation image that has been magnified 5,000λ.

A 256-gradation monochrome image is obtained by carrying out 8-bit grey scale conversion using image processing software (product name: Image-Pro Plus, Media Cybernetics, Inc.). A binarized image is obtained by binarizing the observation image so as to enable differentiation of the carbon black particles. The following are determined using the count function on the obtained image: the cross-sectional area S of the domains within the analysis image and the total cross-sectional area Sc of the carbon black particles, i.e., the electronic conducting agent, present in the domains.

The arithmetic-mean value μr of Sc/S at the nine locations is calculated to give the cross-sectional area percentage for the electronic conductive material in the domains.

The cross-sectional area percentage μr of the electronic conducting agent influences the uniformity of the domain volume resistivity. The uniformity of the domain volume resistivity can be measured as follows in combination with the measurement of the cross-sectional area percentage μr.

Using the measurement method described in the preceding, σr/μr is calculated, as a metric of the uniformity of domain volume resistivity, from μr and the standard deviation or for μr.

Method for Measuring the Periphery Length A and the Envelope Periphery Length B of the Domains Using the count function of the image processing software, the following items are determined on the domain population present in the binarized image of the aforementioned observation image that had been magnified 1,000λ.

periphery length A (μm)

envelope periphery length B (μm)

These values are substituted into the following formula (5), and the arithmetic-mean value for the evaluation images at the nine locations is used.

$$1.00 \leq A/B \leq 1.10 \quad (5)$$

(A: periphery length of domain, B: envelope periphery length of domain)

Method for Measuring the Domain Shape Index

The domain shape index may be determined as the number percentage, with reference to the total number of domains, for the domain population that has a μr (area %) of at least 20% and a domain periphery length ratio A/B that satisfies the preceding formula (5). The domain shape index is preferably from 80 number % to 100 number %.

Using the count function of the image processing software (product name: Image-Pro Plus, Media Cybernetics, Inc.) on the binarized image described above, the size of the domain population within the binarized image is determined and the number percentage of the domains that satisfy μr≥20 and the preceding formula (5) may also be acquired.

By implementing a high density loading by the electronic conducting agent in a domain, as stipulated by component factor (iv), the external shape of the domain can be brought close to that of a sphere, and a low unevenness as stipulated in component factor (v) can also be established.

In order to obtain domains densely loaded with the electronic conducting agent, as stipulated by component factor (iv), the electronic conducting agent preferably has carbon black having a DBP absorption from 40 $cm^3$/100 g to 80 $cm^3$/100 g.

The DBP absorption ($cm^3$/100 g) is the volume of dibutyl phthalate (DBP) that can be absorbed by 100 g of a carbon black and is measured in accordance with Japanese Industrial Standard (JIS) K 6217-4: 2017 (Carbon black for rubber industry—Fundamental characteristics—Part 4: Determination of oil absorption number (including compressed samples)).

Carbon blacks generally have a floc-like higher-order structure in which primary particles having an average particle diameter from 10 nm to 50 nm are aggregated. This floc-like higher-order structure is referred to as "structure", and its extent is quantified by the DBP absorption ($cm^3$/100 g).

A conductive carbon black having a DBP absorption in the indicated range has an undeveloped level of structure, and due to this there is little aggregation of the carbon black and the dispersibility in rubber is excellent. As a consequence, a high loading level in the domains can be achieved, and as a result domains having an external shape more nearly approaching spherical are readily obtained.

In addition, a conductive carbon black having a DBP absorption in the indicated range is resistant to aggregate formation, and as a consequence the formation of domains according to factor (v) is facilitated.

The Domain Diameter D

The arithmetic-mean value of the circle-equivalent diameter D (also referred to herebelow simply as the "domain diameter D") of the domains observed in the cross section of the conductive layer is preferably from 0.10 μm to 5.00 μm.

When this range is adopted, the surfacemost domains assume a size equal to or less than that of the toner, and as a result a fine electrical discharge is made possible and achieving a uniform electrical discharge is facilitated.

By having the average value of the domain diameter D be at least 0.10 in, the charge movement pathways in the conductive layer can be more effectively limited to the desired pathways. At least 0.15 μm is more preferred, and at least 0.20 μm is still more preferred.

By having the average value of the domain diameter D be not more than 5.00 μm, the proportion of the domain surface area to its total volume, i.e., the domain specific surface area, can be exponentially increased and the efficiency of charge discharge from the domains can be very substantially increased. For this reason, the average value of the domain diameter D is preferably not more than 2.00 μm and is more preferably not more than 1.00 μm.

By having the average value of the domain diameter D be not more than 2.00 μm, the electrical resistance of the domain itself can be reduced and due to this the amount of the single-event electrical discharge is brought to the necessary and sufficient amount and a more efficient microdischarge is made possible.

Viewed from the standpoint of pursuing further reductions in electric field concentration between domains, the external shape of the domains preferably more nearly approaches that of a sphere. Due to this, smaller domain diameters within the aforementioned range are preferred. The method for this can be exemplified by kneading the MRC with the CMB in step (iv) to induce phase separation between the MRC and the CMB. Another exemplary method is to exercise control, in the step of preparing a rubber mixture in which CMB domains are formed in the MRC matrix, so as to provide a small CMB domain diameter.

By providing a small CMB domain diameter, the specific surface area of the CMB is increased and the interface with the matrix is enlarged, and due to this a tension acts directed to reducing the tension at the interface of the CMB domain. As a result, the external shape of the CMB domain more nearly approaches that of a sphere.

Taylor's formula (formula (6)), Wu's empirical formulas (formulas (7) and (8)), and Tokita's formula (formula (9)) are known with regard to the factors that govern the domain diameter in a matrix-domain structure formed when two species of incompatible polymers are melt-kneaded.

Taylor's formula $$D=[C\cdot\sigma/\eta m\cdot\gamma]\cdot f(\eta m/\eta d) \quad (6)$$

Wu's empirical formulas $$\gamma\cdot D\cdot\eta m/\sigma=4(\eta d/\eta m)0.84\cdot\eta d/\eta m>1 \quad (7)$$

$$\gamma\cdot D\cdot\eta m/\sigma=4(\eta d/\eta m)-0.84\cdot\eta d/\eta m<1 \quad (8)$$

Tokita's formula $$D=12\cdot P\cdot\sigma\cdot\phi/(\pi\cdot\eta\cdot\gamma)\cdot(1+4\cdot P\cdot\phi\cdot EDK/(\pi\cdot\eta\cdot\gamma)) \quad (9)$$

In formulas (6) to (9), D represents the maximum Feret diameter of the CMB domains; C represents a constant; σ represents interfacial tension; ηm represents the viscosity of the matrix; ηd represents the viscosity of the domains; γ represents the shear rate; η represents the viscosity of the mixed system; P represents the collisional coalescence probability; ϕ represents the domain phase volume; and EDK represents the domain phase severance energy.

In order, in relation to component factor (iii), to provide a uniform interdomain distance, it is effective to provide a small domain diameter in accordance with formulas (6) to (9). In addition, in the process, during the step of kneading the MRC with the CMB, of dividing up the starting rubber for the domains and gradually reducing the particle diameter thereof, the interdomain distance also varies depending on when the kneading step is halted.

Accordingly, the uniformity of the interdomain distance can be controlled using the kneading time in the kneading step and using the kneading rotation rate, which is an index for the intensity of this kneading, and the uniformity of the interdomain distance can be enhanced using a longer kneading time and a larger kneading rotation rate.

Uniformity of the Domain Diameter D:

The domain diameter D is preferably uniform and thus the particle size distribution is preferably narrow. By having a uniform distribution for the domain diameter D traversed by the charge in the conductive layer, charge concentration within the matrix-domain structure is suppressed and the ease of emanation of the electric discharge over the entire surface of the conductive member can be effectively increased.

When, operating in the charge transport cross section, i.e., the cross section in the thickness direction of the conductive layer as shown in FIG. 3B, a 50 μm-square region of observation is taken at three randomly selected locations in the thickness region at a depth of 0.1 T to 0.9 T from the outer surface of the conductive layer in the direction of the support, the σd/D ratio for the standard deviation ad of the domain diameter and the arithmetic-mean value D of the domain diameter (variation coefficient ad/D) is preferably from 0 to 0.40 and is more preferably from 0.10 to 0.30.

To bring about a better uniformity of the domain diameter, the uniformity of the domain diameter is also enhanced when a small domain diameter is established in accordance with formulas (6) to (9), which is equivalent to the aforementioned procedure for enhancing the uniformity of the interdomain distance. Moreover, in the process, during the step of kneading the MRC with the CMB, of dividing up the starting rubber for the domains and gradually reducing the particle diameter thereof, the uniformity of the domain diameter also varies depending on when the kneading step is halted.

Accordingly, the uniformity of the domain diameter can be controlled using the kneading time in the kneading step and using the kneading rotation rate, which is an index for the intensity of this kneading, and the uniformity of the domain diameter can be enhanced using a longer kneading time and a larger kneading rotation rate.

Method for Measuring the Uniformity of the Domain Diameter

The uniformity of the domain diameter can be measured by quantification of the image obtained by direct observation of the fracture surface, which is obtained by the same method for measurement of the uniformity of the interdomain distance as described above. The specific procedure is described below.

Method for Confirming the Matrix-Domain Structure

The presence of a matrix-domain structure in the conductive layer can be confirmed by preparing a thin section of the conductive layer and carrying out a detailed observation of the fracture surface formed on the thin section. The specific procedure is described below.

The Toner

The toner is described in the following.

This toner includes a toner particle containing a binder resin, and an external additive, and the external additive contains a fine particle of a hydrotalcite compound.

Using Lh (μm) for the number-average primary particle diameter of the fine particles of the hydrotalcite compound, Lh is preferably from 0.10 μm to 1.00 μm. When this range is satisfied, the fine particles of the hydrotalcite compound are stably immobilized at the domains and the nitrogen oxide ($NO_x$) can be adsorbed on a long-term basis.

In addition, when Lh is at least 0.10 μm, the hydrotalcite compound fine particles are resistant to aggregate formation and a good nitrogen oxide ($NO_x$) absorption is made possible.

When Lh is not more than 1.00 μm, a favorable transfer of the hydrotalcite compound fine particles from the toner occurs and contamination of members such as the charging member and photosensitive member can be suppressed. Moreover, since the specific surface area becomes suitably large, the nitrogen oxide ($NO_x$) absorption capacity is enhanced. Lh is more preferably from 0.15 μm to 0.75 μm.

Using Ld (μm) for the circle-equivalent diameter of the domains observed at the outer surface of the conductive layer, i.e., the domains exposed at the outer surface of the conductive member, Ld is preferably from 0.10 μm to 2.00 μm, more preferably from 0.15 μm to 1.00 μm, and still more preferably from 0.20 μm to 0.70 μm.

The domain diameter Ld (μm) is preferably equal to or greater than the number-average primary particle diameter Lh (μm) of the hydrotalcite compound fine particles. The domain diameter Ld (μm) is more preferably greater than Lh (μm). These conditions function to provide a more stable immobilization of the hydrotalcite fine particles at the domains. Ld/Lh is more preferably from 1.10 to 4.00.

The Hydrotalcite Compound Fine Particles

The hydrotalcite compound fine particles are described in the following.

The hydrotalcite compound can preferably be represented by the following formula (A). This is an inorganic layer compound that has a positively charged base layer (the $[M^2{}_{1-x}M^{3+}{}_x(OH)^-{}_2]$ in formula (A)) and a negatively charged intermediate layer (the $[x/nA^{n-}.mH_2O]$ in formula (A)).

$$[M^2{}_{1-x}M^{3+}{}_x(OH)^-{}_2][x/nA^{n-}.mH_2O] \quad (A)$$

In formula (A), $M^{2+}$ represents a divalent metal ion such as $Mg^{2+}$, $Zn^{2+}$, and so forth;

$M^{3+}$ represents a trivalent metal ion such as $Al^{3+}$, $Fe^{3+}$, and so forth;

$A^{n-}$ represents an n-valent anion such as $CO_3{}^{2-}$, $Cl^-$, $NO_3{}^-$, and so forth; and $m \geq 0$.

The following is an example of a compound encompassed by formula (A):

$$[Mg^{2+}{}_{0.750}Al^{3+}{}_{0.250}(OH)^-{}_{2.000}][0.125CO_3{}^{2-}.0.500H_2O].$$

With such a hydrotalcite compound, and deriving from its structure, it is thought that immobilization to the domains is facilitated since the particle surface is positively charged and that interlayer adsorption of nitrogen oxide readily occurs. It is thought that as a result, in high-temperature, high-humidity environments contact on the photosensitive member between nitrogen oxide and moisture in the environment is prevented and image smearing is inhibited.

From the standpoint of the ability to provide charge, $Mg^{2+}$ is preferred for the divalent metal ion $M^{2+}$ in formula (A) and $Al^{3+}$ is preferred for the trivalent metal ion $M^{3+}$. From the standpoint of providing charging to the toner particle, $CO_3{}^{2-}$ and $Cl^-$ are preferred for the n-valent anion.

The content of the hydrotalcite compound fine particles is preferably from 0.01 mass parts to 3.00 mass parts per 100 mass parts of the toner particle. The inhibitory effect on image smearing is readily obtained when the content is in this range. From 0.10 mass parts to 1.00 mass parts is more preferred.

The immobilization percentage of the hydrotalcite compound fine particles on the toner particle is more preferably from 20% to 60%. When the immobilization percentage is in this range, hydrotalcite compound fine particles remain on the toner and a stable increase in the charging performance is brought about, but at the same time they also transfer to the charging member and a more significant image smearing-inhibiting effect is established. From 40% to 60% is a more preferred range.

The immobilization percentage of the hydrotalcite compound fine particles on the toner particle can be controlled by adjustment of the amount of addition, particle diameter, and external addition conditions for the hydrotalcite compound fine particles and by adjustment of the characteristics of the toner particle.

Other external additives may be added to the toner particle in addition to the hydrotalcite compound fine particles. Examples in this regard are fine particles of a titanate salt, and, from the standpoint of enhancing the charging performance and imparting flowability, silica fine particles. The silica fine particles are more preferably treated silica fine particles provided by subjecting the surface thereof to a hydrophobic treatment.

The treated silica fine particles are preferably silica fine particles having a hydrophobicity, as measured using the methanol titration test, of 30 volume % to 80 volume %. The content of the silica fine particles, per 100 mass parts of the toner particle, is preferably from 0.10 mass parts to 4.50 mass parts and more preferably from 0.10 mass parts to 3.00 mass parts.

Toner Particle Production Methods

The method for manufacturing the toner particle is explained here.

A known method may be used as the toner particle manufacturing method, such as a kneading pulverization method or wet manufacturing method. A wet manufacturing method is preferred from the standpoint of shape control and obtaining a uniform particle diameter. Examples of wet manufacturing methods include suspension polymerization methods, solution suspension methods, emulsion polymerization-aggregation methods, emulsion aggregation methods and the like, and an emulsion aggregation method is preferred.

In emulsion aggregation methods, materials such as a binder resin fine particle, a colorant fine particle and the like are dispersed and mixed in an aqueous medium containing a dispersion stabilizer. A surfactant may also be added to the aqueous medium. A flocculant is then added to aggregate the mixture until the desired toner particle size is reached, and the resin fine particles are also fused together either after or during aggregation. Shape control with heat may also be performed as necessary in this method to form a toner particle.

The binder resin fine particle here may be a composite particle formed as a multilayer particle comprising two or more layers composed of resins with different compositions. This can be manufactured for example by an emulsion polymerization method, mini-emulsion polymerization method, phase inversion emulsion method or the like, or by a combination of multiple manufacturing methods.

When the toner particle contains an internal additive such as a colorant, the internal additive may be included originally in the resin fine particle, or a liquid dispersion of an internal additive fine particle consisting only of the internal additive may be prepared separately, and the internal additive fine particles may then be aggregated together when the resin fine particles are aggregated.

Resin fine particles with different compositions may also be added at different times during aggregation, and aggregated to prepare a toner particle composed of layers with different compositions.

The following may be used as the dispersion stabilizer:

inorganic dispersion stabilizers such as tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina.

Other examples include organic dispersion stabilizers such as polyvinyl alcohol, gelatin, methyl cellulose, methyl hydroxypropyl cellulose, ethyl cellulose, carboxymethyl cellulose sodium salt, and starch.

A known cationic surfactant, anionic surfactant or nonionic surfactant may be used as the surfactant.

Specific examples of cationic surfactants include dodecyl ammonium bromide, dodecyl trimethylammonium bromide, dodecylpyridinium chloride, dodecylpyridinium bromide, hexadecyltrimethyl ammonium bromide and the like.

Specific examples of nonionic surfactants include dodecylpolyoxyethylene ether, hexadecylpolyoxyethylene ether, nonylphenylpolyoxyethylene ether, lauryl polyoxyethylene ether, sorbitan monooleate polyoxyethylene ether, styrylphenyl polyoxyethylene ether, monodecanoyl sucrose and the like.

Specific examples of anionic surfactants include aliphatic soaps such as sodium stearate and sodium laurate, and sodium lauryl sulfate, sodium dodecylbenzene sulfonate, sodium polyoxyethylene (2) lauryl ether sulfate and the like.

The binder resin constituting the toner is explained next.

Preferred examples of the binder resin include vinyl resins, polyester resins and the like. Examples of vinyl resins, polyester resins and other binder resins include the following resins and polymers:

monopolymers of styrenes and substituted styrenes, such as polystyrene and polyvinyl toluene; styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer and styrene-maleic acid ester copolymer; and polymethyl methacryalte, polybutyl methacrylate, polvinyl acetate, polyethylene, polypropylene, polvinyl butyral, silicone resin, polyamide resin, epoxy resin, polyacrylic resin, rosin, modified rosin, terpene resin, phenol resin, aliphatic or alicyclic hydrocarbon resins and aromatic petroleum resins. These binder resins may be used individually or mixed together.

The binder resin preferably contains carboxyl groups, and is preferably a resin manufactured using a polymerizable monomer containing a carboxyl group. Examples of the polymerizable monomer containing a carboxyl group include vinylic carboxylic acids such as acrylic acid, methacrylic acid, α-ethylacrylic acid and crotonic acid; unsaturated dicarboxylic acids such as fumaric acid, maleic acid, citraconic acid and itaconic acid; and unsaturated dicarboxylic acid monoester derivatives such as monoacryloyloxyethyl succinate ester, monomethacryloyloxyethyl succinate ester, monoacryloyloxyethyl phthalate ester and monomethacryloyloxyethyl phthalate ester.

Polycondensates of the carboxylic acid components and alcohol components listed below may be used as the polyester resin. Examples of carboxylic acid components include terephthalic acid, isophthalic acid, phthalic acid, fumaric acid, maleic acid, cyclohexanedicarboxylic acid and trimellitic acid. Examples of alcohol components include bisphenol A, hydrogenated bisphenols, bisphenol A ethylene oxide adduct, bisphenol A propylene oxide adduct, glycerin, trimethyloyl propane and pentaerythritol.

The polyester resin may also be a polyester resin containing a urea group. Preferably the terminal and other carboxyl groups of the polyester resins are not capped.

To control the molecular weight of the binder resin constituting the toner particle, a crosslinking agent may also be added during polymerization of the polymerizable monomers.

Examples include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinyl benzene, bis (4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, polyester diacrylate (MANDA, Nippon Kayaku Co., Ltd.), and these with methacrylate substituted for the acrylate.

The added amount of the crosslinking agent is preferably from 0.001 to 15.000 mass parts per 100 mass parts of the polymerizable monomers.

A release agent is preferably included as one of the materials constituting the toner. In particular, a plasticization effect is easily obtained using an ester wax with a melting point of from 60° C. to 90° C. because the wax is highly compatible with the binder resin.

Examples of the ester wax include waxes having fatty acid esters as principal components, such as carnauba wax and montanic acid ester wax; those obtained by deoxidizing part or all of the oxygen component from the fatty acid ester, such as deoxidized carnauba wax; hydroxyl group-containing methyl ester compounds obtained by hydrogenation or the like of vegetable oils and fats; saturated fatty acid monoesters such as stearyl stearate and behenyl behenate; diesterified products of saturated aliphatic dicarboxylic acids and saturated fatty alcohols, such as dibehenyl sebacate, distearyl dodecanedioate and distearyl octadecanedioate; and diesterified products of saturated aliphatic diols and saturated aliphatic monocarboxylic acids, such as nonanediol dibehenate and dodecanediol distearate.

Of these waxes, it is desirable to include a bifunctional ester wax (diester) having two ester bonds in the molecular structure.

A bifunctional ester wax is an ester compound of a dihydric alcohol and an aliphatic monocarboxylic acid, or an ester compound of a divalent carboxylic acid and a fatty monoalcohol.

Specific examples of the aliphatic monocarboxylic acid include myristic acid, palmitic acid, stearic acid, arachidic acid, behenic acid, lignoceric acid, cerotic acid, montanic acid, melissic acid, oleic acid, vaccenic acid, linoleic acid and linolenic acid.

Specific examples of the fatty monoalcohol include myristyl alcohol, cetanol, stearyl alcohol, arachidyl alcohol, behenyl alcohol, tetracosanol, hexacosanol, octacosanol and triacontanol.

Specific examples of the divalent carboxylic acid include butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, tridecaendioic acid, tetradecanedioic acid, hexadecanedioic acid, octadecanedioic acid, eicosanedioic acid, phthalic acid, isophthalic acid, terephthalic acid and the like.

Specific examples of the dihydric alcohol include ethylene glycol, propylene glycol, 1,3-propanediol, 1,4-butanediol, 1,5-pentanediol, 1,6-hexanediol, 1,10-decanediol, 1,12-dodecanediol, 1,14-tetradecanediol, 1,16-hexadecanediol, 1,18-octadecanediol, 1,20-eicosanediol, 1,30-triacontanediol, diethylene glycol, dipropylene glycol, 2,2,4-trimethyl-1,3-pentanediol, neopentyl glycol, 1,4-cyclohexane dimethanol, spiroglycol, 1,4-phenylene glycol, bisphenol A, hydrogenated bisphenol A and the like.

Other release agents that can be used include petroleum waxes such as paraffin wax, microcrystalline wax and petrolatum, and their derivatives; montanic wax and its derivatives, hydrocarbon waxes obtained by the Fischer-Tropsch method and their derivatives, polyolefn waxes such as polyethylene and polypropylene and their derivatives, natural waxes such as carnauba wax and candelilla wax and their derivatives, higher fatty alcohols, and fatty acids such as stearic acid and palmitic acid, or ester compounds thereof.

The content of the release agent is preferably from 5.0 mass parts to 20.0 mass parts per 100.0 mass parts of the binder resin or polymerizable monomers.

A colorant may also be included in the toner. The colorant is not specifically limited, and the following known colorants may be used.

Examples of yellow pigments include yellow iron oxide, Naples yellow, naphthol yellow S, Hansa yellow G, Hansa yellow 10G, benzidine yellow G, benzidine yellow GR, quinoline yellow lake, permanent yellow NCG, condensed azo compounds such as tartrazine lake, isoindolinone compounds, anthraquinone compounds, azo metal complexes, methine compounds and allylamide compounds. Specific examples include:

C.I. pigment yellow 12, 13, 14, 15, 17, 62, 74, 83, 93, 94, 95, 109, 110, 111, 128, 129, 147, 155, 168 and 180.

Examples of red pigments include red iron oxide, permanent red 4R, lithol red, pyrazolone red, watching red calcium salt, lake red C, lake red D, brilliant carmine 6B, brilliant carmine 3B, eosin lake, rhodamine lake B, condensed azo compounds such as alizarin lake, diketopyrrolopyrrole compounds, anthraquinone compounds, quinacridone compounds, basic dye lake compounds, naphthol compounds, benzimidazolone compounds, thioindigo compound and perylene compounds. Specific examples include:

C.I. pigment red 2, 3, 5, 6, 7, 23, 48:2, 48:3, 48:4, 57:1, 81:1, 122, 144, 146, 166, 169, 177, 184, 185, 202, 206, 220, 221 and 254.

Examples of blue pigments include alkali blue lake, Victoria blue lake, phthalocyanine blue, metal-free phthalocyanine blue, phthalocyanine blue partial chloride, fast sky blue, copper phthalocyanine compounds such as indathrene blue BG and derivatives thereof, anthraquinone compounds and basic dye lake compounds. Specific examples include:

C.I. pigment blue 1, 7, 15, 15:1, 15:2, 15:3, 15:4, 60, 62 and 66.

Examples of black pigments include carbon black and aniline black. These colorants may be used individually, or as a mixture, or in a solid solution.

The content of the colorant is preferably from 3.0 mass parts to 15.0 mass parts per 100.0 mass parts of the binder resin.

The toner particle may also contain a charge control agent. A known charge control agent may be used. A charge control agent that provides a rapid charging speed and can stably maintain a uniform charge quantity is especially desirable.

Examples of charge control agents for controlling the negative charge properties of the toner particle include as follows.

Examples include organic metal compounds and chelate compounds, including monoazo metal compounds, acetylacetone metal compounds, aromatic oxycarboxylic acids, aromatic dicarboxylic acids, and metal compounds of oxycarboxylic acids and dicarboxylic acids. Other examples include aromatic oxycarboxylic acids, aromatic mono- and polycarboxylic acids and their metal salts, anhydrides and esters, and phenol derivatives such as bisphenols and the like. Further examples include urea derivatives, metal-containing salicylic acid compounds, metal-containing naphthoic acid compounds, boron compounds, quaternary ammonium salts and calixarenes.

Meanwhile, examples of charge control agents for controlling the positive charge properties of the toner particle include nigrosin and nigrosin modified with fatty acid metal salts; guanidine compounds; imidazole compounds; quaternary ammonium salts such as tributylbenzylammonium-1-hydroxy-4-naphthosulfonate salt and tetrabutylammonium tetrafluoroborate, onium salts such as phosphonium salts that are analogs of these, and lake pigments of these; triphenylmethane dyes and lake pigments thereof (using phosphotungstic acid, phosphomolybdic acid, phosphotungstenmolybdic acid, tannic acid, lauric acid, gallic acid, ferricyanic acid or a ferrocyan compound or the like as the laking agent); metal salts of higher fatty acids; and resin charge control agents.

One charge control agent alone or a combination of two or more kinds may be included.

The content of the charge control agent is preferably from 0.01 mass parts to 10.00 mass parts per 100.00 mass parts of the binder resin or polymerizable monomers.

The Process Cartridge

The process cartridge has the following features.

A process cartridge detachably provided to a main body of an electrophotographic apparatus, the process cartridge including a charging unit for charging the surface of an electrophotographic photosensitive member, and a developing unit for forming a toner image on the surface of the electrophotographic photosensitive member by developing an electrostatic latent image formed on the surface of the electrophotographic photosensitive member with a toner, wherein the developing unit includes a toner; and the charging unit includes a conductive member disposed to be contactable with the electrophotographic photosensitive member.

The toner and the conductive member that have been described above can be used in this process cartridge.

The process cartridge may include a frame in order to support the charging unit and the developing unit.

Figure 4:
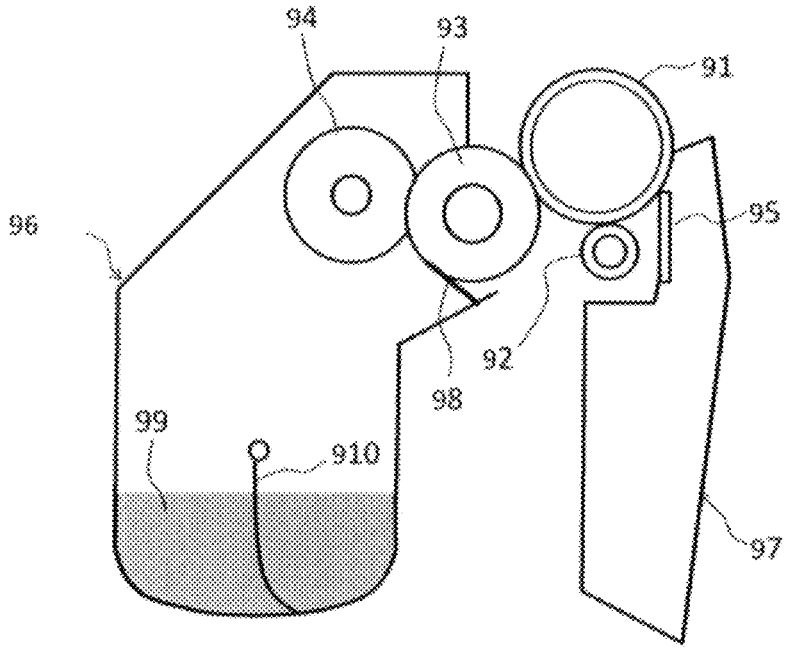
FIG. 4 is a schematic diagram of a process cartridge.

FIG. 4 is a schematic cross-sectional diagram of an electrophotographic process cartridge equipped with a conductive member as a charging roller. This process cartridge includes a developing unit and charging unit formed into a single article and is configured to be detachable from and attachable to the main body of an electrophotographic apparatus.

The developing unit is provided with at least a developing roller 93, and includes a toner 99. The developing unit may optionally include a toner supply roller 94, a toner container 96, a developing blade 98, and a stirring blade 910 formed into a single article.

The charging unit should be provided with at least a charging roller 92 and may be provided with a cleaning blade 95 and a waste toner container 97. The conductive member should be disposed to be contactable with the electrophotographic photosensitive member, and due to this the electrophotographic photosensitive member (photosensitive drum 91) may be integrated with the charging unit as a constituent element of the process cartridge or may be fixed in the main body as a constituent element of the electrophotographic apparatus.

A voltage may be applied to each of the charging roller 92, developing roller 93, toner supply roller 94, and developing blade 98.

The Electrophotographic Apparatus

The electrophotographic apparatus has the following features.

An electrophotographic apparatus including an electrophotographic photosensitive member, a charging unit for charging a surface of the electrophotographic photosensitive member, and a developing unit for forming a toner image on the surface of the electrophotographic photosensitive member by developing an electrostatic latent image formed on the surface of the electrophotographic photosensitive member with a toner, wherein the charging unit includes a conductive member disposed to be contactable with the electrophotographic photosensitive member.

The toner and the conductive member that have been described above can be used in this electrophotographic apparatus.

The electrophotographic apparatus may include an image-wise exposure unit for irradiating the surface of the electrophotographic photosensitive member with image-wise exposure light to form an electrostatic latent image on the electrophotographic photosensitive member;

a transfer unit for transferring a toner image formed on the surface of the electrophotographic photosensitive member to a recording medium; and a fixing unit for fixing, to the recording medium, the toner that has been transferred to the recording medium.

Figure 5:
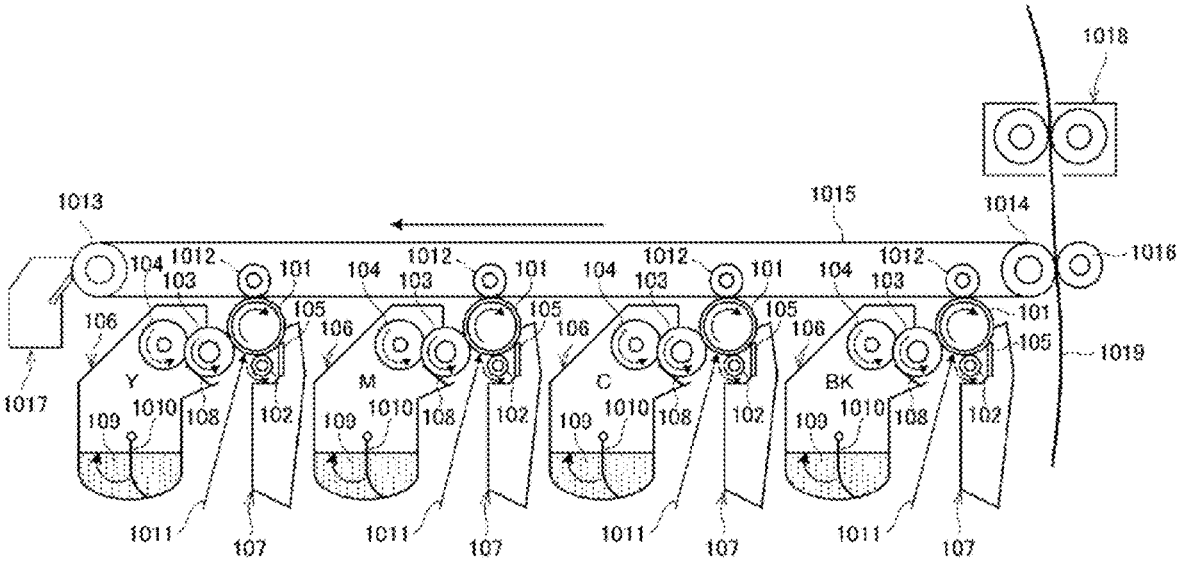
FIG. 5 is a schematic cross-sectional diagram of an electrophotographic apparatus.

FIG. 5 is a schematic component diagram of an electrophotographic apparatus that uses a conductive member as a charging roller. This electrophotographic apparatus is a color electrophotographic apparatus in which four process cartridges are detachably mounted. Toners in each of the following colors are used in the respective process cartridges: black, magenta, yellow, and cyan.

A photosensitive drum 101 rotates in the direction of the arrow and is uniformly charged by a charging roller 102, to which a voltage has been applied from a charging bias power source, and an electrostatic latent image is formed on the surface of the photosensitive drum 101 by exposure light 1011. On the other hand, a toner 109, which is stored in a toner container 106, is supplied by a stirring blade 1010 to a toner supply roller 104 and is transported onto a developing roller 103.

The toner 109 is uniformly coated onto the surface of the developing roller 103 by a developing blade 108 disposed in contact with the developing roller 103, and in combination with this charge is imparted to the toner 109 by triboelectric charging. The electrostatic latent image is visualized as a toner image by development by the application of the toner 109 transported by the developing roller 103 disposed in contact with the photosensitive drum 101.

The visualized toner image on the photosensitive drum is transferred, by a primary transfer roller 1012 to which a voltage has been applied from a primary transfer bias power source, to an intermediate transfer belt 1015, which is supported and driven by a tension roller 1013 and an intermediate transfer belt driver roller 1014. The toner image for each color is sequentially stacked to form a color image on the intermediate transfer belt.

A transfer material 1019 is fed into the apparatus by a paper feed roller and is transported to between the intermediate transfer belt 1015 and a secondary transfer roller 1016. Under the application of a voltage from a secondary transfer bias power source, the secondary transfer roller 1016 transfers the color image on the intermediate transfer belt 1015 to the transfer material 1019. The transfer material 1019 to which the color image has been transferred is subjected to a fixing process by a fixing unit 1018 and is discharged from the apparatus to complete the printing operation.

Otherwise, the untransferred toner remaining on the photosensitive drum is scraped off by a cleaning blade 105 and is held in a waste toner collection container 107, and the cleaned photosensitive drum 101 repeats the aforementioned process. In addition, untransferred toner remaining on the primary transfer belt is also scraped off by a cleaning unit 1017.

The Cartridge Set

The cartridge set has the following features.

A cartridge set including a first cartridge and a second cartridge detachably provided to a main body of an electrophotographic apparatus, wherein the first cartridge includes a charging unit for charging a surface of an electrophotographic photosensitive member and a first frame for supporting the charging unit;

the second cartridge includes a toner container that holds a toner for forming a toner image on the surface of the electrophotographic photosensitive member by developing an electrostatic latent image formed on the surface of the electrophotographic photosensitive member; and the charging unit includes a conductive member disposed to be contactable with the electrophotographic photosensitive member.

The toner and the conductive member that have been described above can be used in this cartridge set.

Since the conductive member should be disposed to be contactable with the electrophotographic photosensitive member, the first cartridge may be provided with the electrophotographic photosensitive member or the electrophotographic photosensitive member may be fixed in the main body of the electrophotographic apparatus. For example, the first cartridge may have an electrophotographic photosensitive member, a charging unit for charging the surface of the electrophotographic photosensitive member, and a first frame for supporting the electrophotographic photosensitive member and the charging unit. However, the second cartridge may be provided with the electrophotographic photosensitive member.

The first cartridge or the second cartridge may be provided with a developing unit for forming a toner image on the surface of the electrophotographic photosensitive member. The developing unit may be fixed in the main body of the electrophotographic apparatus.

The methods used to measure the various properties are described herebelow. The Number-Average Primary Particle Diameter of the External Additive The number-average primary particle diameter of the external additive is measured using an "S-4800" scanning electron microscope (product name, Hitachi, Ltd.). Observation is carried out on the toner to which the external additive has been added; the long diameter of 100 randomly selected primary particles of the external additive is measured in a field of view that has been magnified by a maximum of 50,000×; and the number-average particle diameter is calculated. The magnification for the observation is adjusted as appropriate in accordance with the size of the external additive.

Method for Identifying the Hydrotalcite Compound Fine Particles

The hydrotalcite compound can be identified by a combination of shape observation by scanning electron microscopy (SEM) and elemental analysis by energy dispersive X-ray analysis (EDS).

The toner is observed in a field enlarged to a maximum magnification of 50,000× with an "S-4800" (trade name) scanning electron microscope (Hitachi, Ltd.). The microscope is focused on the toner particle surface, and the external additive to be distinguished is observed. The external additive to be distinguished is subjected to EDS analysis, and the hydrotalcite compound is identified based on the presence or absence of elemental peaks.

For the elemental peaks, if the elemental peak of at least one metal selected from the group consisting of the metals Mg, Zn, Ca, Ba, Ni, Sr, Cu and Fe, and the elemental peak of at least one metal selected from the group consisting of Al, B, Ga, Fe, Co and In that may constitute the hydrotalcite compound are observed, the presence of a hydrotalcite compound containing these two metals can be deduced.

A standard sample of the hydrotalcite compound deduced from EDS analysis is prepared separately, and subjected to EDS analysis and SEM shape observation. A particle to be distinguished can be judged to be a hydrotalcite compound based on whether the analysis results for the standard sample match the analysis results for the particle to be distinguished.

Method for Measuring the Number-Average Primary Particle Diameter (Lh) of the Hydrotalcite Compound Fine Particles The location of occurrence of the hydrotalcite compound present on the toner surface can be determined by observation and elemental analysis using an S-4800 ultrahigh resolution field emission scanning electron microscope (Hitachi High-Technologies Corporation) (SEM-EDS).

Measurement is carried out on the fine particles discriminated by this method as hydrotalcite compound fine particles.

The method for measuring the number-average primary particle diameter of the hydrotalcite compound fine particles is described in the following.

(1) Specimen Preparation

An electroconductive paste is spread in a thin layer on the specimen stub (15 mm×6 mm aluminum specimen stub) and the toner is sprayed onto this. Blowing with air is additionally performed to remove excess toner from the specimen stub and carry out thorough drying. The specimen stub is set in the specimen holder and the specimen stub height is adjusted to 36 mm with the specimen height gauge.

(2) Setting the Conditions for Observation with the S-4800

Liquid nitrogen is introduced to the brim of the anti-contamination trap attached to the S-4800 housing and standing for 30 minutes is carried out. The "PCSTEM" of the S-4800 is started and flashing is performed (the FE tip, which is the electron source, is cleaned). The acceleration voltage display area in the control panel on the screen is clicked and the [flashing] button is pressed to open the flashing execution dialog. A flashing intensity of 2 is confirmed and execution is carried out. The emission current due to flashing is confirmed to be 20 to 40 μA. The specimen holder is inserted in the specimen chamber of the S-4800 housing. [home] is pressed on the control panel to transfer the specimen holder to the observation position.

The acceleration voltage display area is clicked to open the HV setting dialog and the acceleration voltage is set to [0.8 kV] and the emission current is set to [20 μA]. In the [base] tab of the operation panel, signal selection is set to [SE], [upper (U)] and [+BSE] are selected for the SE detector, and the instrument is placed in backscattered electron image observation mode by selecting [L. A. 100] in the selection box to the right of [+BSE]. Similarly, in the [base] tab of the operation panel, the probe current of the electron optical system condition block is set to [Normal], the focus mode is set to [UHR], and WD is set to [3.0 mm]. The [ON] button in the acceleration voltage display area of the control panel is pressed to apply the acceleration voltage.

(3) Observation with the S-4800

The magnification is set to 100,000 (100 k) by dragging within the magnification indicator area of the control panel. Turning the [COARSE] focus knob on the operation panel, adjustment of the aperture alignment is carried out where some degree of focus has been obtained. [Align] in the control panel is clicked and the alignment dialog is displayed and [beam] is selected. The displayed beam is migrated to the center of the concentric circles by turning the STIGMA/ALIGNMENT knobs (X, Y) on the operation panel.

[aperture] is then selected and the STIGMA/ALIGNMENT knobs (X, Y) are turned one at a time and adjustment is performed so as to stop the motion of the image or minimize the motion. The aperture dialog is closed and focus is performed with the autofocus. This operation is repeated an additional two times to achieve focus.

The particle diameter is then measured on at least 300 hydrotalcite compound fine particles on the toner surface and the number-average primary particle diameter (Lh) is calculated. The hydrotalcite compound fine particles also occur as aggregated particles, but these aggregated particles are not targeted for measurement of the particle diameter. In addition, the maximum diameter is treated as the particle diameter, and the number-average primary particle diameter (Lh) is obtained by taking the arithmetic mean of the maximum diameters.

Method for Measuring the Immobilization Percentage on the Toner Particle of the Hydrotalcite Compound Fine Particles Two types of samples (pre-water-wash toner, post-water-wash toner) are first prepared.

(i) pre-water-wash toner: the toner submitted for measurement is used as such.

(ii) post-water-wash toner: A sucrose concentrate is prepared by the addition of 160 g of sucrose (Kishida Chemical Co., Ltd.) to 100 mL of deionized water and dissolving while heating on a water bath. 31 g of this sucrose concentrate and 6 mL of Contaminon N (a 10 mass % aqueous solution of a neutral pH 7 detergent for cleaning precision measurement instrumentation, including a nonionic surfactant, anionic surfactant, and organic builder, Wako Pure Chemical Industries, Ltd.) are introduced into a centrifugal separation tube to prepare a dispersion.

1 g of the toner to be measured is added to this dispersion, and clumps of the toner are broken up using, for example, a spatula. The centrifugal separation tube is shaken for 20 min at 5.8 $s^{-1}$ using a shaker. After shaking, the solution is transferred into a glass tube (50 mL) for swing rotor service and centrifugal separation is carried out using conditions of 30 min at 58.3 $s^{-1}$. Adequate separation of the toner and aqueous solution is visually confirmed, and the toner separated into the uppermost layer is collected using, for example, a spatula. An aqueous solution containing the collected toner is filtered using a vacuum filter, followed by drying for at least one hour in a dryer to give the sample.

Using these pre-water-wash and post-water-wash samples, the amount of immobilization is determined by quantifying the group 2 element-containing hydrotalcite compound fine particles using wavelength-dispersive x-ray fluorescence (XRF) and the intensity for the target element (Mg for group 2 element-containing hydrotalcite compound fine particles).

1 g of either the pre-water-wash toner or post-water-wash toner is introduced into a specialized aluminum compaction ring and is smoothed over, and, using a "BRE-32" tablet compression molder (Maekawa Testing Machine Mfg. Co., Ltd.), a pellet is produced by molding to a thickness of 2 mm by compression for 60 seconds at 20 MPa, and this pellet is used as the measurement sample.

An "Axios" wavelength-dispersive x-ray fluorescence analyzer (PANalytical B.V.) is used as the measurement instrumentation, and the "SuperQ ver. 4.0F" (PANalytical B.V.) software provided with the instrument is used in order to set the measurement conditions and analyze the measurement data. Rh is used for the x-ray tube anode; a vacuum is used for the measurement atmosphere; the measurement diameter (collimator mask diameter) is 10 mm; and the measurement time is 10 seconds.

Detection is carried out with a proportional counter (PC) in the case of measurement of light elements, and with a scintillation counter (SC) in the case of measurement of heavy elements. The measurement is run under the conditions given above, and the elements are identified based on the peak position of the obtained x-rays and their concentrations are calculated from the count rate (unit: cps), which is the number of x-ray photons per unit time.

The element intensity is first determined for the pre-water-wash toner and the post-water-wash toner using the method described above. The immobilization percentage (%) is then calculated based on the following formula. The formula is given using the example of Mg as the target element.

immobilization percentage (%) of the hydrotalcite compound fine particles=(intensity for the element Mg for the post-water-wash toner)/(intensity for the element Mg for the pre-water-wash toner)×100

Method for Measuring Average Circularity of Toner

The average circularity of the toner is measured with an "FPIA-3000" flow particle image analyzer (Sysmex Corporation) under the measurement and analysis conditions for calibration operations.

The specific measurement methods are as follows.

20 mL of ion-exchange water from which solid impurities and the like have been removed is first placed in a glass container. 0.2 mL of a dilute solution of "Contaminon N" (a 10 mass % aqueous solution of a pH 7 neutral detergent for washing precision instruments, comprising a nonionic surfactant, an anionic surfactant and an organic builder, manufactured by Wako Pure Chemical Industries, Ltd.) diluted three times by mass with ion-exchange water is then added as a dispersant.

0.02 g of the measurement sample is then added and dispersed for 2 minutes with an ultrasonic disperser to obtain a dispersion for measurement. Cooling is performed as appropriate during this process so that the temperature of the dispersion is 10° C. to 40° C.

Using a tabletop ultrasonic cleaner and disperser having an oscillating frequency of 50 kHz and an electrical output of 150 W (for example, "VS-150" manufactured by Velvo-Clear) as an ultrasonic disperser, a predetermined amount of ion-exchange water is placed on the water tank, and 2 mL of the Contaminon N is added to the tank.

A flow particle image analyzer equipped with a "LUCPLFLN" objective lens (magnification 20×, aperture 0.40) is used for measurement, with particle sheath "PSE-900A" (Sysmex Corporation) as the sheath liquid. The liquid dispersion obtained by the procedures above is introduced into the flow particle image analyzer, and 2,000 toner particles are measured in HPF measurement mode, total count mode.

The average circularity of the toner is then determined with a binarization threshold of 85% during particle analysis, and with the analyzed particle diameters limited to equivalent circle diameters of from 1.977 to less than 39.54 μm.

Prior to the start of measurement, autofocus adjustment is performed using standard latex particles (for example, Duke Scientific Corporation "RESEARCH AND TEST PARTICLES Latex Microsphere Suspensions 5100A" diluted with ion-exchange water). Autofocus adjustment is then performed again every two hours after the start of measurement.

Method for Measuring Weight-average Particle Diameter (D4) of Toner

The weight-average particle diameter (D4) of the toner is calculated as follows. A "Multisizer 3 Coulter Counter" precise particle size distribution analyzer (registered trademark, Beckman Coulter, Inc.) based on the pore electrical resistance method and equipped with a 100 μm aperture tube is used as the measurement unit together with the accessory dedicated "Beckman Coulter Multisizer 3 Version 3.51" software (Beckman Coulter, Inc.) for setting the measurement conditions and analyzing the measurement data. Measurement is performed with 25,000 effective measurement channels.

The aqueous electrolytic solution used in measurement may be a solution of special grade sodium chloride dissolved in ion-exchanged water to a concentration of 1 mass %, such as "ISOTON II" (Beckman Coulter, Inc.) for example.

The following settings are performed on the dedicated software prior to measurement and analysis.

On the "Change standard measurement method (SOMME)" screen of the dedicated software, the total count number in control mode is set to 50,000 particles, the number of measurements to 1, and the Kd value to a value obtained with "Standard particles 10.0 m" (Beckman Coulter, Inc.). The threshold and noise level are set automatically by pushing the "Threshold/noise level measurement" button. The current is set to 1,600 μA, the gain to 2, and the electrolytic solution to ISOTON II, and a check is entered for "Aperture tube flush after measurement".

On the "Conversion settings from pulse to particle diameter" screen of the dedicated software, the bin interval is set to the logarithmic particle diameter, the particle diameter bins to 256, and the particle diameter range to 2 to 60 μm.

The specific measurement methods are as follows.

(1) 200 mL of the aqueous electrolytic solution is placed in a glass 250 mL round-bottomed beaker dedicated to the Multisizer 3, the beaker is set on the sample stand, and stirring is performed with a stirrer rod counter-clockwise at a rate of 24 rps. Contamination and bubbles in the aperture tube are then removed by the "Aperture tube flush" function of the dedicated software.

(2) 30 mL of the same aqueous electrolytic solution is placed in a glass 100 mL flat-bottomed beaker, and 0.3 mL of a dilution of "Contaminon N" (a 10 mass % aqueous solution of a pH 7 neutral detergent for washing precision instruments, comprising a nonionic surfactant, an anionic surfactant, and an organic builder, manufactured by Wako Pure Chemical Industries, Ltd.) diluted three times by mass with ion-exchange water is added.

(3) An ultrasonic disperser "Ultrasonic Dispersion System Tetra150" (Nikkaki Bios Co., Ltd.) with an electrical output of 120 W equipped with two built-in oscillators having an oscillating frequency of 50 kHz with their phases shifted by 180° from each other is prepared. 3.3 L of ion-exchange water is added to the water tank of the ultrasonic disperser, and 2 mL of Contaminon N is added to the tank.

(4) The beaker of (2) above is set in the beaker-fixing hole of the ultrasonic disperser, and the ultrasonic disperser is operated. The height position of the beaker is adjusted so as to maximize the resonant condition of the liquid surface of the aqueous electrolytic solution in the beaker.

(5) The aqueous electrolytic solution in the beaker of (4) above is exposed to ultrasound as 10 mg of toner is added bit by bit to the aqueous electrolytic solution, and dispersed. Ultrasound dispersion is then continued for a further 60 seconds. During ultrasound dispersion, the water temperature in the tank is adjusted appropriately to from 10° C. to 40° C.

(6) The aqueous electrolytic solution of (5) above with the toner dispersed therein is dripped with a pipette into the round-bottomed beaker of (1) above set on the sample stand, and adjusted to a measurement concentration of 5%. Measurement is then performed until the number of measured particles reaches 50,000.

(7) The measurement data is analyzed with the dedicated software included with the apparatus, and the weight-average particle diameter (D4) is calculated. The weight-average particle diameter (D4) is the "Average diameter" on the "Analysis/volume statistical value (arithmetic mean)" screen when graph/volume % is set in the dedicated software.

Method for Measuring the Glass Transition Temperature (Tg)

The glass transition temperature (Tg) of, e.g., the toner, is measured using a "Q2000" differential scanning calorimeter (TA Instruments) in accordance with ASTM D 3418-82.

A 2 mg measurement sample is precisely weighed out and introduced into an aluminum pan; an empty aluminum pan is used for reference.

From 30° C. to 200° C. is used as the measurement temperature range. The temperature is raised from 30° C. to 200° C. at a ramp rate of 10° C./min; cooling is then carried out from 200° C. to 30° C. at a ramp down rate of 10° C./min; and the temperature is subsequently raised again to 200° C. at a ramp rate of 10° C./min.

Using the DSC curve obtained in this second ramp up step, the glass transition temperature (Tg) is taken to be the point at the intersection between the differential heat curve and the line for the midpoint for the baselines for prior to and subsequent to the appearance of the change in the specific heat.

Confirmation of a Matrix-Domain Structure

The presence/absence of the formation of a matrix-domain structure in the conductive layer of the conductive member is checked using the following method.

Using a razor, a section (thickness=500 μm) is cut out so as to enable the cross section orthogonal to the longitudinal direction of the conductive layer of the conductive member to be observed. Platinum vapor deposition is then carried out and a cross-sectional image is photographed using a scanning electron microscope (SEM) (product name: S-4800, Hitachi High-Technologies Corporation) and a magnification of 1,000×.

Figure 2:
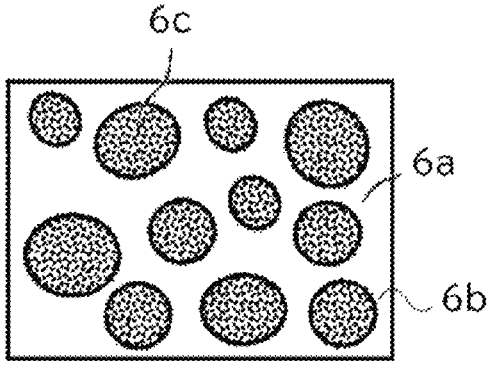
FIG. 2 is an enlarged cross-sectional diagram of a conductive layer.

A matrix-domain structure observed in the section from the conductive layer presents a morphology in which, in the cross-sectional image, a plurality of domains 6*b* are dispersed in a matrix 6*a* and the domains are present in an independent state without connection to each other, as in FIG. 2. 6*c* is an electronic conducting agent. The matrix, on the other hand, resides in a state that is continuous within the image with the domains being partitioned off by the matrix.

In order to quantify the obtained photographed image, a 256-gradation monochrome image is obtained by carrying out 8-bit grey scale conversion using image processing software (product name: Image-Pro Plus, Media Cybernetics, Inc.) on the fracture surface image yielded by the SEM observation. White/black reversal processing is then carried out on the image so the domains in the fracture surface become white, followed by generation of the binarized image with the binarization threshold being set based on the algorithm of Otsu's adaptive thresholding method for the brightness distribution of images.

Using the count function on this binarized image, and operating in a 50 μm-square region, the number percentage K is calculated for the domains that, as noted above, are isolated without connection between domains, with reference to the total number of domains that do not have a contact point with the enclosure lines for the binarized image.

Specifically, the count function of the image processing software is set to not count domains that have a contact point with the enclosure lines for the edges in the four directions of the binarized image.

The arithmetic-mean value (number %) for K is calculated by carrying out this measurement on the aforementioned sections prepared at a total of 20 points, as provided by randomly selecting 1 point from each of the regions obtained by dividing the conductive layer of the conductive member into 5 equal portions in the longitudinal direction and dividing the circumferential direction into 4 equal portions.

A matrix-domain structure is scored as being "present" when the arithmetic-mean value of K (number %) is equal to or greater than 80, and is scored as being "absent" when the arithmetic-mean value of K (number %) is less than 80.

Measurement of the Volume Resistivity R1 of the Matrix

The volume resistivity R1 of the matrix can be measured, for example, by excising, from the conductive layer, a thin section of prescribed thickness (for example, 1 μm) that contains the matrix-domain structure and bringing the microprobe of a scanning probe microscope (SPM) or atomic force microscope (AFM) into contact with the matrix in this thin section.

With regard to the excision of the thin section from the elastic layer, and, for example, as shown in FIG. 3B letting the X axis be the longitudinal direction of the conductive member, the Z axis be the thickness direction of the conductive layer, and the Y axis be its circumferential direction, the thin section is excised so as to contain at least a portion of a plane parallel to the YZ plane (for example, 83*a*, 83*b*, 83*c*), which is orthogonal to the axial direction of the conductive member. Excision can be carried out, for example, using a sharp razor, a microtome, or a focused ion beam technique (FIB).

The volume resistivity is measured by grounding one side of the thin section that has been excised from the conductive layer. The microprobe of a scanning probe microscope (SPM) or atomic force microscope (AFM) is brought into contact with the matrix part on the surface of the side opposite from the ground side of the thin section; a 50 V DC voltage is applied for 5 seconds; the arithmetic-mean value is calculated from the values measured for the ground current value for the 5 seconds; and the electrical resistance value is calculated by dividing the applied voltage by this calculated value. Finally, the resistance value is converted to the volume resistivity using the film thickness of the thin section. The SPM or AFM can also be used to measure the film thickness of the thin section at the same time as measurement of the resistance value.

For a column-shaped charging member, the value of the volume resistivity R1 of the matrix is determined, for example, by excising one thin section sample from each of the regions obtained by dividing the conductive layer into four parts in the circumferential and 5 parts in the longitudinal direction; obtaining the measurement values described above; and calculating the arithmetic-mean value of the volume resistivities for the total of 20 samples.

In the present examples, first a 1 μm-thick thin section was excised from the conductive layer of the conductive member at a slicing temperature of −100° C. using a microtome (product name: Leica EMFCS, Leica Microsystems GmbH). Using the X axis for the longitudinal direction of the conductive member, the Z axis for the thickness direction of the conductive layer, and the Y axis for its circumferential direction, as shown in FIG. 3B, excision was performed such that the thin section contained at least a portion of the YZ plane (for example, 83*a*, 83*b*, 83*c*), which is orthogonal with respect to the axial direction of the conductive member.

Operating in an environment having a temperature of 23° C. and a humidity of 50%, one side of the thin section (also referred to hereafter as the "ground side") was grounded on a metal plate, and the cantilever of a scanning probe microscope (SPM) (product name: Q-Scope 250, Quesant Instrument Corporation) was brought into contact at a location corresponding to the matrix on the side (also referred to hereafter as the "measurement side") opposite from the ground side of the thin section, and where domains were not present between the measurement side and ground side. A voltage of 50 V was then applied to the cantilever for 5 seconds; the current value was measured; and the 5-second arithmetic-mean value was calculated.

The surface profile of the section subjected to measurement was observed with the SPM and the thickness of the measurement location was calculated from the obtained height profile. In addition, the depressed portion area of the cantilever contact region was calculated from the results of observation of the surface profile. The volume resistivity was calculated from this thickness and this depressed portion area.

With regard to the thin sections, the aforementioned measurement was performed on sections prepared at a total of 20 points, as provided by randomly selecting 1 point from each of the regions obtained by dividing the conductive layer of the conductive member into 5 equal portions in the longitudinal direction and dividing the circumferential direction into 4 equal portions. The average value was used as the volume resistivity R1 of the matrix.

The scanning probe microscope (SPM) (product name: Q-Scope 250, Quesant Instrument Corporation) was operated in contact mode.

Measurement of the Volume Resistivity R2 of the Domains

The volume resistivity R2 of the domains is measured by the same method as for measurement of the matrix volume resistivity R1 as described above, but carrying out the measurement at a location corresponding to a domain in the ultrathin section and changing the measurement voltage to 1 V.

In the present examples, R2 was calculated using the same method as above (measurement of the matrix volume resistivity R1), but changing the voltage applied during measurement of the current value to 1 V and changing the location of cantilever contact on the measurement side to a location corresponding to a domain, and where the matrix was not present between the measurement side and ground side.

Measurement of the Circle-Equivalent Diameter D of Domains Observed from the Cross Section of the Conductive Layer The circle-equivalent diameter D of the domains is determined as follows.

Using L for the length in the longitudinal direction of the conductive layer and T for the thickness of the conductive layer, 1 μm-thick samples, having sides as represented by cross sections in the thickness direction (83*a*, 83*b*, 83*c*) of the conductive layer as shown in FIG. 3B, are sliced using a microtome (product name: Leica EMFCS, Leica Microsystems GmbH) from three locations, i.e., the center in the longitudinal direction of the conductive layer and at L/4 toward the center from either end of the conductive layer.

For each of the obtained three samples, platinum vapor deposition is performed on the cross section of the thickness direction of the conductive layer. Operating on the platinum vapor-deposited surface of each sample, a photograph is taken at 5,000× using a scanning electron microscope (SEM) (product name: S-4800, Hitachi High-Technologies Corporation) at three randomly selected locations within the thickness region that is a depth of 0.1 T to 0.9 T from the outer surface of the conductive layer.

Using image processing software (product name: Image-Pro Plus, Media Cybernetics, Inc.), each of the obtained nine photographed images is subjected to binarization and quantification using the count function and the arithmetic-mean value S of the area of the domains contained in each of the photographed images is calculated.

The circle-equivalent domain diameter ($=(4S/\pi)^{0.5}$) is then calculated from the calculated arithmetic-mean value S of the domain area for each of the photographed images. The arithmetic-mean value of the circle-equivalent domain diameter for each photographed image is subsequently calculated to obtain the circle-equivalent diameter D of the domains observed from the cross section of the conductive layer of the conductive member that is the measurement target.

Measurement of the Particle Size Distribution of the Domains

In order to evaluate the uniformity of the circle-equivalent diameter D of the domains, the particle size distribution of the domains is measured proceeding as follows. First, binarized images are obtained using image processing software (product name: Image-Pro Plus, Media Cybernetics, Inc.) from the 5,000× observed images obtained using a scanning electron microscope (product name: S-4800, Hitachi High-Technologies Corporation) in the above-described measurement of the circle-equivalent diameter D of the domains. Then, using the count function of the image processing software, the average value D and the standard deviation ad are calculated for the domain population in the binarized image, and σd/D, which is a metric of the particle size distribution, is subsequently calculated.

For the measurement of the σd/D particle size distribution of the domain diameters, and using L for the length in the longitudinal direction of the conductive layer and T for the thickness of the conductive layer, cross sections in the thickness direction of the conductive layer, as shown in FIG. 3B, are taken at three locations, i.e., the center in the longitudinal direction of the conductive layer and at L/4 toward the center from either end of the conductive layer. Operating at a total of 9 locations, i.e., 3 randomly selected locations in the thickness region at a depth of 0.1 T to 0.9 T from the outer surface of the conductive layer, in each of the 3 sections obtained at the aforementioned 3 measurement locations, a 50 μm-square region is extracted as the analysis image; the measurement is performed; and the arithmetic-mean value for the 9 locations is calculated.

The Circle-Equivalent Diameter Ld of the Domains Observed from the Outer Surface of the Conductive Layer The circle-equivalent diameter Ld of the domains observed from the outer surface of the conductive layer is measured as follows.

A sample containing the outer surface of the conductive layer is excised using a microtome (product name: Leica EMFCS, Leica Microsystems GmbH) at three locations, i.e., the center in the longitudinal direction of the conductive layer and at L/4 toward the center from either end of the conductive layer where L is the length in the longitudinal direction of the conductive layer. The sample thickness is 1 μm.

Platinum vapor deposition is performed on the sample surface that corresponds to the outer surface of the conductive layer. Three locations are randomly selected on the platinum vapor-deposited surface of the sample and are photographed at 5,000× using a scanning electron microscope (SEM) (product name: S-4800, Hitachi High-Technologies Corporation). Using image processing software (product name: Image-Pro Plus, Media Cybernetics, Inc.), each of the obtained total of 9 photographed images is subjected to binarization and quantification using the count function, and the arithmetic-mean value Ss of the planar area of the domains present in each of the photographed images is calculated.

The circle-equivalent domain diameter ($=(4S/\pi)^{0.5}$) is then calculated from the calculated arithmetic-mean value Ss of the domain planar area for each of the photographed images. The arithmetic-mean value of the circle-equivalent domain diameter for each photographed image is then calculated to obtain the circle-equivalent diameter Ld of the domains in observation of the conductive member that is the measurement target from the outer surface.

Measurement of the Interdomain Distance Dm Observed from the Cross Section of the Conductive Layer Using L for the length in the longitudinal direction of the conductive layer and T for the thickness of the conductive layer, samples, having sides as represented by the cross sections in the thickness direction (83*a*, 83*b*, 83*c*) of the conductive layer as shown in FIG. 3B, are taken from three locations, i.e., the center in the longitudinal direction of the conductive layer and at L/4 toward the center from either end of the conductive layer.

For each of the obtained three samples, a 50 μm-square analysis region is placed, on the surface presenting the cross section in the thickness direction of the conductive layer, at three randomly selected locations in the thickness region from a depth of 0.1 T to 0.9 T from the outer surface of the conductive layer. These three analysis regions are photographed at a magnification of 5,000× using a scanning electron microscope (product name: S-4800, Hitachi High-Technologies Corporation). Each of the obtained total of 9 photographed images is binarized using image processing software (product name: LUZEX, Nireco Corporation).

The binarization procedure is carried out as follows. 8-bit grey scale conversion is performed on the photographed image to obtain a 256-gradation monochrome image. White/black reversal processing is carried out on the image so the domains in the photographed image become white, and binarization is performed to obtain a binarized image of the photographed image. For each of the 9 binarized images, the distances between the domain wall surfaces are then calculated, and the arithmetic-mean value of these is calculated. This is designated Dm. The distance between the wall surfaces is the distance between the wall surfaces of domains that are nearest to each other (shortest distance), and can be determined by setting the measurement parameters in the image processing software to the distance between adjacent wall surfaces.

Measurement of the Uniformity of the Interdomain Distance Dm

The standard deviation σm of the interdomain distance is calculated from the distribution of the distance between the domain wall surfaces obtained in the procedure described above for measuring the interdomain distance Dm, and the variation coefficient σm/Dm, with is a metric of the uniformity of the interdomain distance, is calculated.

EXAMPLES

The invention is explained in more detail below based on examples and comparative examples, but the invention is in no way limited to these. Unless otherwise specified, parts in the examples are based on mass.

Toner manufacturing examples are explained.

Preparation of Binder Resin Particle Dispersion 89.5 parts of styrene, 9.2 parts of butyl acrylate, 1.3 parts of acrylic acid and 3.2 parts of n-lauryl mercaptane were mixed and dissolved. An aqueous solution of 1.5 parts of Neogen RK (DKS Co., Ltd.) in 150 parts of ion-exchange water was added and dispersed in this mixed solution.

This was then gently stirred for 10 minutes as an aqueous solution of 0.3 parts of potassium persulfate mixed with 10 parts of ion-exchange water was added.

After nitrogen purging, emulsion polymerization was performed for 6 hours at 70° C. After completion of polymerization, the reaction solution was cooled to room temperature, and ion-exchange water was added to obtain a binder resin particle dispersion with a volume-based median particle diameter of 0.2 μm and a solids concentration of 12.5 mass %.

Preparation of Release Agent Dispersion 100 parts of a release agent (behenyl behenate, melting point: 72.1° C.) and 15 parts of Neogen RK were mixed with 385 parts of ion-exchange water, and dispersed for about 1 hour with a JN100 wet jet mill (Jokoh Co., Ltd.) to obtain a release agent dispersion. The solids concentration of the release agent dispersion was 20 mass %.

Preparation of Colorant Dispersion 100 parts of carbon black "Nipex35 (Orion Engineered Carbons)" and 15 parts of Neogen RK were mixed with 885 parts of ion-exchange water, and dispersed for about 1 hour in a JN100 wet jet mill to obtain a colorant dispersion.

Preparation of Toner Particle 1

265 parts of the binder resin particle dispersion, 10 parts of the release agent dispersion and 10 parts of the colorant dispersion were dispersed with a homogenizer (IKA Japan K.K.: Ultra-Turrax T50).

The temperature inside the vessel was adjusted to 30° C. under stirring, and 1 mol/L hydrochloric acid was added to adjust the pH to 5.0. This was left for 3 minutes before initiating temperature rise, and the temperature was raised to 50° C. to produce aggregate particles. The particle diameter of the aggregate particles was measured under these conditions with a "Multisizer 3 Coulter Counter" (registered trademark, Beckman Coulter, Inc.). Once the weight-average particle diameter reached 6.2 μm, 1 mol/L sodium hydroxide aqueous solution was added to adjust the pH to 8.0 and arrest particle growth.

The temperature was then raised to 95° C. to fuse and spheroidize the aggregate particles. Temperature lowering was initiated when the average circularity reached 0.980, and the temperature was lowered to 30° C. to obtain a toner particle dispersion 1.

Hydrochloric acid was added to adjust the pH of the resulting toner particle dispersion 1 to 1.5 or less, and the dispersion was stirred for 1 hour, left standing, and then subjected to solid-liquid separation in a pressure filter to obtain a toner cake.

This was made into a slurry with ion-exchange water, re-dispersed, and subjected to solid-liquid separation in the previous filter unit. Re-slurrying and solid-liquid separation were repeated until the electrical conductivity of the filtrate was not more than 5.0 μS/cm, to perform final solid-liquid separation and obtain a toner cake.

The resulting toner cake was dried with a Flash Jet air dryer (Seishin Enterprise Co., Ltd.). The drying conditions were a blowing temperature of 90° C. and a dryer outlet temperature of 40° C., with the toner cake supply speed adjusted according to the moisture content of the toner cake so that the outlet temperature did not deviate from 40° C. Fine and coarse powder was cut with a multi-division classifier using the Coanda effect, to obtain a toner particle 1. The toner particle 1 had a weight-average particle diameter (D4) of 6.3 m, an average circularity of 0.980, and a glass transition temperature (Tg) of 57° C.

Hydrotalcite Compound Fine Particle Production Example 1

203.3 g of magnesium chloride hexahydrate and 96.6 g of aluminum chloride hexahydrate were dissolved in 1 L of deionized water, and, while holding this solution at 25° C., the pH was adjusted to 10.5 using a solution of 60 g of sodium hydroxide dissolved in 1 L of deionized water. Ageing was carried out for 24 hours at 98° C.

After cooling, the precipitate was washed with deionized water until the conductivity of the filtrate reached 100 μS/cm or less, and a slurry with a concentration of 5 mass % was prepared. While being stirred, this slurry was spray dried using a spray dryer (DL-41, Yamato Scientific Co., Ltd.) at a drying temperature of 180° C., a spray pressure of 0.16 MPa, and a spray rate of approximately 150 mL/min to obtain hydrotalcite compound fine particle H-1.

The composition was determined to be the following from the results of thermogravimetric analysis, x-ray fluorescence analysis, and CHN elemental analysis. The properties of the hydrotalcite compound fine particles are given in Table 1.

$$Mg^{2+}_{0.692}Al^{3+}_{0.308}(OH)^{-}_{2.000}\cdot 0.154CO_3^{2-}\cdot 0.538H_2O$$

Hydrotalcite Compound Fine Particle Production Example 2

Hydrotalcite compound fine particle H-2 was obtained proceeding as in the Production Example 1, but changing the magnesium chloride hexahydrate to 246.5 g of magnesium sulfate heptahydrate, changing the aluminum chloride hexahydrate to 126.1 g of aluminum sulfate hexadecahydrate, and adjusting the pH using a solution in which 53 g of sodium carbonate was dissolved in addition to the 60 g of sodium hydroxide.

The composition was determined to be the following from the results of thermogravimetric analysis, x-ray fluorescence analysis, and CHN elemental analysis. The properties of the hydrotalcite compound fine particles are given in Table 1.

$$Mg^{2+}_{0.692}Al^{3+}_{0.308}(OH)^{-}_{2.000}\cdot 0.150CO_3^{2-}\cdot 0.555H_2O$$

Hydrotalcite Compound Fine Particle Production Example 3

Hydrotalcite compound fine particles were produced proceeding as in the Production Example 1, but changing the magnesium chloride hexahydrate to 256.4 g of magnesium nitrate hexahydrate, changing the aluminum chloride hexahydrate to 150.1 g of aluminum nitrate nonahydrate, and adjusting the pH using a solution in which 53 g of sodium carbonate was dissolved in addition to the 60 g of sodium hydroxide. Hydrotalcite compound fine particle H-3 was then obtained by carrying out a classification process.

The composition was determined to be the following from the results of thermogravimetric analysis, x-ray fluorescence analysis, and CHN elemental analysis. The properties of the hydrotalcite compound fine particles are given in Table 1.

$$Mg^{2+}_{0.692}Al^{3+}_{0.308}(OH)^{-}_{2.000}\cdot 0.141CO_3^{2-}\cdot 0.502H_2O$$

Hydrotalcite Compound Fine Particle Production Example 4

Hydrotalcite compound fine particle H-4 was obtained proceeding as in the Production Example 1, but adjusting the pH using a solution in which 53 g of sodium carbonate was dissolved in addition to the 60 g of sodium hydroxide, and changing the spray drying conditions at the spray dryer to a spray pressure of 0.12 MPa and a spray rate of approximately 110 mL/min.

The composition was determined to be the following from the results of thermogravimetric analysis, x-ray fluorescence analysis, and CHN elemental analysis. The properties of the hydrotalcite compound fine particles are given in Table 1.

$$Mg^{2+}_{0.692}Al^{3+}_{0.308}(OH)^{-}_{2.000}\cdot 0.155CO_3^{2-}\cdot 0.544H_2O$$

Hydrotalcite Compound Fine Particle Production Example 5

Hydrotalcite compound fine particle H-5 was obtained by subjecting the hydrotalcite compound H-2 to a classification process. The properties of the hydrotalcite compound fine particles are given in Table 1.

Hydrotalcite Compound Fine Particle Production Example 6 Hydrotalcite compound fine particle H-6 was obtained by subjecting the hydrotalcite compound H-2 to a classification process. The properties of the hydrotalcite compound fine particles are given in Table 1.

Hydrotalcite Compound Fine Particle Production Example 7

Hydrotalcite compound fine particle H-7 was obtained by subjecting the hydrotalcite compound H-3 to a classification process. The properties of the hydrotalcite compound fine particles are given in Table 1.

TABLE 1

| No. | number-average primary particle diameter (μm) |
|---|---|
| H-1 | 0.45 |
| H-2 | 0.12 |
| H-3 | 0.80 |
| H-4 | 1.75 |
| H-5 | 0.17 |
| H-6 | 0.07 |
| H-7 | 0.70 |

Silica Fine Particle 1 Production Example

An untreated dry silica having a number-average primary particle diameter of 18 nm was introduced into a stirrer-equipped reactor and was heated to 200° C. in a fluidized state brought about by stirring.

The interior of the reactor was substituted by nitrogen gas and the reactor was sealed; 25 parts of dimethylsilicone oil (viscosity=100 $mm^2/s$) was sprayed in per 100 parts of the dry silica; and stirring was continued for 30 minutes. The temperature was then raised to 250° C. while stirring and stirring was carried out for an additional 2 hours; this was followed by removal and execution of a pulverization treatment to give silica fine particle 1. The hydrophobicity of silica fine particle 1 was 90 (volume %).

Toner Production Example 1

The hydrotalcite compound fine particle H-5 (0.3 parts) and silica fine particle 1 (1.2 parts) were externally added to and mixed with the obtained toner particle 1 (100 parts) using an FM10C (Nippon Coke & Engineering Co., Ltd.).

External addition was carried out using the following conditions: amount of toner particle introduction: 2.0 kg, rotation rate: 66.6 $s^{-1}$, external addition time: 12 minutes, temperature of cooling water: 20° C., flow rate: 11 L/min.

Screening was then performed on a mesh with an aperture of 200 μm to give toner 1.

Toner Production Examples 2 to 8

Toners 2 to 8 were obtained proceeding as in the Toner Production Example 1, but changing, as described in Table 2, the type and amount of addition of the toner particle, hydrotalcite compound fine particles, and silica fine particles that were used.

TABLE 2

| | Toner particle | Hydrotalcite compound | Number of parts | Immobilization percentage (%) | Silica fine particle | Number of parts |
|---|---|---|---|---|---|---|
| Toner 1 | Toner particle 1 | H-5 | 0.3 | 55 | Silica fine particle 1 | 1.2 |
| Toner 2 | Toner particle 1 | H-1 | 0.3 | 50 | Silica fine particle 1 | 1.2 |
| Toner 3 | Toner particle 1 | H-7 | 0.3 | 46 | Silica fine particle 1 | 1.2 |
| Toner 4 | Toner particle 1 | H-3 | 0.3 | 43 | Silica fine particle 1 | 1.2 |
| Toner 5 | Toner particle 1 | H-2 | 0.3 | 57 | Silica fine particle 1 | 1.2 |
| Toner 6 | Toner particle 1 | H-6 | 0.3 | 65 | Silica fine particle 1 | 1.2 |
| Toner 7 | Toner particle 1 | H-4 | 0.3 | 32 | Silica fine particle 1 | 1.2 |
| Toner 8 | Toner particle 1 | None | None | — | Silica fine particle 1 | 1.2 |

Conductive Member 1 Production Example

[1-1. Preparation of Domain-Forming Rubber Mixture (CMB)]

A CMB was obtained by mixing the materials indicated in Table 3 at the amounts of incorporation given in Table 3, using a 6-liter pressure kneader (product name: TD6-15MDX, Toshin Co., Ltd.). The mixing conditions were a fill ratio of 70 volume %, a blade rotation rate of 30 rpm, and 30 minutes.

TABLE 3

| | Ingredient name | Amount of incorporation (parts) |
|---|---|---|
| Starting rubber | Styrene-butadiene rubber (product name: TUFDENE 1000, Asahi Kasei Corporation) | 100 |
| Electronic conducting agent | Carbon black (product name: TOKABLACK #5500, Tokai Carbon Co., Ltd.) | 60 |
| Vulcanization co-accelerator | Zinc oxide (product name: Zinc White, Sakai Chemical Industry Co., Ltd.) | 5 |
| Processing aid | Zinc stearate (product name: SZ-2000, Sakai Chemical Industry Co., Ltd.) | 2 |

1-2. Preparation of Matrix-Forming Rubber Mixture (MRC)

An MRC was obtained by mixing the materials indicated in Table 4 at the amounts of incorporation given in Table 4, using a 6-liter pressure kneader (product name: TD6-15MDX, Toshin Co., Ltd.). The mixing conditions were a fill ratio of 70 volume %, a blade rotation rate of 30 rpm, and 16 minutes.

TABLE 4

| | Ingredient name | Amount of incorporation (parts) |
|---|---|---|
| Starting rubber | Butyl rubber (product name: JSR Butyl 065, JSR Corporation) | 100 |

TABLE 4-continued

| | Ingredient name | Amount of incorporation (parts) |
|---|---|---|
| Filler | Calcium carbonate (product name: NANOX #30, Maruo Calcium Co., Ltd.) | 70 |
| Vulcanization co-accelerator | Zinc oxide (product name: Zinc White, Sakai Chemical Industry Co., Ltd.) | 7 |
| Processing aid | Zinc stearate (product name: SZ-2000, Sakai Chemical Industry Co., Ltd.) | 2.8 |

1-3. Preparation of Unvulcanized Rubber Mixture for Conductive Layer Formation

The CMB and the MRC obtained as described above were mixed at the amounts of incorporation given in Table 5 using a 6-liter pressure kneader (product name: TD6-15MDX, Toshin Co., Ltd.). The mixing conditions were a fill ratio of 70 volume %, a blade rotation rate of 30 rpm, and 20 minutes.

TABLE 5

| | Ingredient name | Amount of incorporation (parts) |
|---|---|---|
| Starting rubber | Domain-forming rubber mixture | 25 |
| Starting rubber | Matrix-forming rubber mixture | 75 |

The vulcanizing agent and vulcanization accelerator indicated in Table 6 were then added in the amounts of incorporation indicated in Table 6 to 100 parts of the CMB+MRC mixture, and mixing was carried out using an open roll with a 12-inch (0.30 m) roll diameter to prepare a rubber mixture for conductive layer formation.

With regard to the mixing conditions, the front roll rotation rate was 10 rpm, the back roll rotation rate was 8 rpm, the roll gap was 2 mm, and turn buck was performed right and left a total of 20 times; this was followed by 10 thin passes on a roll gap of 0.5 mm.

TABLE 6

| | Ingredient name | Amount of incorporation (parts) |
|---|---|---|
| Vulcanizing agent | Sulfur (product name: SULFAX PMC, Tsurumi Chemical Industry Co., Ltd.) | 3 |

TABLE 6-continued

| | Ingredient name | Amount of incorporation (parts) |
|---|---|---|
| Vulcanization accelerator | Tetramethylthiuram disulfide (product name: TT, Ouchi Shinko Chemical Industrial Co., Ltd.) | 3 |

2. Production of the Conductive Member 2-1. Preparation of a Support Having a Conductive Outer Surface A round bar having a total length of 252 mm and an outer diameter of 6 mm, and having an electroless nickel plating treatment executed on a stainless steel (SUS) surface, was prepared as the support having a conductive outer surface.

2-2. Molding the Conductive Layer

A die with an inner diameter of 12.5 mm was mounted at the tip of a crosshead extruder having a feed mechanism for the support and a discharge mechanism for the unvulcanized rubber roller, and the temperature of the extruder and crosshead was adjusted to 80° C. and the support transport speed was adjusted to 60 mm/sec. Operating under these conditions, the rubber mixture for conductive layer formation was fed from the extruder and the outer circumference of the support was coated in the crosshead with this rubber mixture for conductive layer formation to yield an unvulcanized rubber roller.

The unvulcanized rubber roller was then introduced into a 160° C. convection vulcanization oven and the rubber mixture for conductive layer formation was vulcanized by heating for 60 minutes to obtain a roller having a conductive layer formed on the outer circumference of the support. 10 mm was then cut off from each of the two ends of the conductive layer to provide a length of 231 mm for the longitudinal direction of the conductive layer portion.

Finally, the surface of the conductive layer was ground using a rotary grinder. This yielded a crowned conductive member (charging roller) 1 having a diameter at the center of 8.5 mm and a diameter of 8.44 mm at each of the positions 90 mm toward each of the ends from the center. The results of the evaluation are given in Table 9.

Conductive Members 2 to 12 Production Example

Conductive members 2 to 12 were produced proceeding as for conductive member 1, but using the materials and conditions indicated in Table 7A-1 and Table 7A-2 with regard to the starting rubber, conducting agent, vulcanizing agent, and vulcanization accelerator.

The details for the materials indicated in Table 7A-1 and Table 7A-2 are given in Table 7B-1 for the rubber materials, Table 7B-2 for the conducting agents, and Table 7B-3 for the vulcanizing agents and vulcanization accelerators.

The properties of the obtained conductive members are given in Table 9.

TABLE 7A-1

| | Domain-forming rubber mixture | | | | | | | | |
|---|---|---|---|---|---|---|---|---|---|
| | Type of starting rubber | | | | Conducting agent | | | Dispersing | |
| Conductive member No. | Abbreviation for material | | SP value | Mooney viscosity | Type | Parts | DBP | time min | Mooney viscosity |
| 1 | SBR | T1000 | 16.8 | 45 | #5500 | 60 | 155 | 30 | 84 |
| 2 | SBR | T1000 | 16.8 | 45 | #5500 | 60 | 155 | 20 | 92 |
| 3 | EPDM | Esplene505A | 16.0 | 47 | #5500 | 65 | 155 | 30 | 94 |
| 4 | Butyl | JSR Butyl 065 | 15.8 | 32 | #5500 | 65 | 155 | 30 | 93 |
| 5 | SBR | T1000 | 16.8 | 45 | #7360 | 45 | 87 | 40 | 60 |
| 6 | Butyl | JSR Butyl 065 | 15.8 | 32 | #5500 | 65 | 155 | 30 | 93 |

TABLE 7A-1-continued

| Conductive member No. | Domain-forming rubber mixture: Type of starting rubber: Abbreviation for material | | SP value | Mooney viscosity | Conducting agent: Type | Parts | DBP | Dispersing time min | Mooney viscosity |
|---|---|---|---|---|---|---|---|---|---|
| 7 | SBR | T2100 | 17.0 | 78 | #5500 | 80 | 155 | 30 | 105 |
| 8 | NBR | N230S | 20.0 | 32 | #7360 | 40 | 87 | 30 | 50 |
| 9 | SBR | T1000 | 16.8 | 45 | #5500 | 60 | 155 | 20 | 92 |
| 10 | EPDM | JSR Butyl 065 | 15.8 | 32 | #5500 | 65 | 155 | 20 | 93 |
| 11 | BR | JSR T0700 | 17.1 | 43 | #7360 | 80 | 87 | 30 | 85 |
| 12 | SBR | T2003 | 17.0 | 45 | — | — | — | — | 45 |
| 13 | NBR | N230SV | 19.2 | 32 | LV | 3 | — | 30 | 35 |

The Mooney viscosity values in the table for the rubber starting materials are catalogue values provided by the particular company. The values for the domain-forming rubber mixtures are the Mooney viscosity $ML_{(1+4)}$ based on JIS K 6300-1:2013, and were measured at the rubber temperature when all of the materials constituting the domain-forming rubber mixture were being kneaded. The unit for the SP value is $(J/cm^3)^{0.5}$, and DBP refers to the amount of DBP absorption ($cm^3$/100 g).

The Mooney viscosity values in the table for the rubber starting materials are catalogue values provided by the particular company. The values for the matrix-forming rubber mixtures are the Mooney viscosity $ML_{(1+4)}$ based on JIS K 6300-1:2013, and were measured at the rubber temperature when all of the materials constituting the matrix-forming rubber mixture were being kneaded. The unit for the SP value is $(J/cm^3)^{0.5}$.

TABLE 7A-2

| Conductive member No. | Matrix-forming rubber mixture: Type of starting rubber: Abbreviation for material | | SP value | Mooney viscosity | Conducting agent: Type | Parts | Mooney viscosity | Unvulcanized rubber composition: Domain Parts |
|---|---|---|---|---|---|---|---|---|
| 1 | Butyl | JSR Butyl 065 | 15.8 | 32 | — | — | 40 | 25 |
| 2 | Butyl | JSR Butyl 065 | 15.8 | 32 | — | — | 40 | 23 |
| 3 | SBR | T2003 | 17.0 | 33 | — | — | 53 | 25 |
| 4 | SBR | T2003 | 17.0 | 33 | — | — | 52 | 24 |
| 5 | SBR | A303 | 17.0 | 46 | — | — | 52 | 22 |
| 6 | BR | T0700 | 17.1 | 43 | — | — | 53 | 21 |
| 7 | EPDM | Esplene301A | 17.0 | 44 | — | — | 48 | 15 |
| 8 | EPDM | Esplene301A | 17.0 | 44 | — | — | 52 | 35 |
| 9 | Butyl | JSR Butyl 065 | 15.8 | 32 | — | — | 40 | 22 |
| 10 | BR | T0700 | 17.1 | 43 | — | — | 50 | 25 |
| 11 | NBR | N230SV | 19.2 | 32 | — | — | 37 | 25 |
| 12 | NBR | N230SV | 19.2 | 32 | #7360 | 60 | 74 | 75 |
| 13 | — | — | — | — | — | — | — | 100 |

| Conductive member No. | Unvulcanized rubber composition: Matrix Parts | Unvulcanized rubber dispersion: Rotation rate rpm | Kneading time min | Vulcanizing agent: Material | Parts | Vulcanization accelerator: Abbreviation for material | Parts |
|---|---|---|---|---|---|---|---|
| 1 | 75 | 30 | 20 | Sulfur | 3 | TT | 3 |
| 2 | 77 | 30 | 16 | Sulfur | 3 | TT | 3 |
| 3 | 75 | 30 | 20 | Sulfur | 3 | TET | 1 |
| 4 | 76 | 30 | 20 | Sulfur | 2 | TT | 2 |
| 5 | 78 | 30 | 20 | Sulfur | 2 | TT | 2 |
| 6 | 79 | 30 | 20 | Sulfur | 3 | TT | 3 |
| 7 | 85 | 30 | 20 | Sulfur | 3 | TET | 3 |
| 8 | 65 | 30 | 20 | Sulfur | 3 | TET | 3 |
| 9 | 78 | 30 | 16 | Sulfur | 3 | TT | 3 |
| 10 | 75 | 20 | 5 | Sulfur | 3 | TT | 3 |
| 11 | 75 | 30 | 20 | Sulfur | 3 | TBZTD | 1 |
| 12 | 25 | 30 | 20 | Sulfur | 3 | TBZTD | 1 |
| 13 | 0 | — | — | Sulfur | 3 | TBZTD | 1 |

TABLE 7B-1

| Rubber Materials | | | | |
|---|---|---|---|---|
| Abbreviation for material | | Material name | Product name | Manufacturer |
| Butyl | Butyl065 | Butyl rubber | JSR Butyl 065 | JSR Corporation |
| BR | T0700 | Polybutadiene rubber | JSR T0700 | JSR Corporation |
| ECO | CG103 | Epichlorohydrin rubber | EPICHLOMER CG103 | Osaka Soda Co., Ltd. |
| EPDM | Esplene301A | Ethylene-propylene-diene rubber | Esprene 301A | Sumitomo Chemical Co., Ltd. |
| EPDM | Esplene505A | Ethylene-propylene-diene rubber | Esprene 505A | Sumitomo Chemical Co., Ltd. |
| NBR | DN401LL | Acrylonitrile-butadiene rubber | Nipol DN401LL | ZEON Corporation |
| NBR | N230SV | Acrylonitrile-butadiene rubber | NBR N230SV | JSR Corporation |
| NBR | N230S | Acrylonitrile-butadiene rubber | NBR N230S | JSR Corporation |
| NBR | N202S | Acrylonitrile-butadiene rubber | NBR N202S | JSR Corporation |
| SBR | T2003 | Styrene-butadiene rubber | TUFDENE 2003 | Asahi Kasei Corporation |
| SBR | T1000 | Styrene-butadiene rubber | TUFDENE 1000 | Asahi Kasei Corporation |
| SBR | T2100 | Styrene-butadiene rubber | TUFDENE 2100 | Asahi Kasei Corporation |
| SBR | A303 | Styrene-butadiene rubber | ASAPREN 303 | Asahi Kasei Corporation |

TABLE 7B-2

| Conducting agents | | | |
|---|---|---|---|
| Abbreviation for material | Material name | Product name | Manufacturer |
| #7360 | Conductive carbon black | TOKABLACK #7360SB | Tokai Carbon Co., Ltd. |
| #5500 | Conductive carbon black | TOKABLACK #5500 | Tokai Carbon Co., Ltd. |
| KETJEN | Conductive carbon black | Carbon ECP | Lion Specialty Chemicals Co., Ltd. |
| LV | Ionic conducting agent | LV70 | ADEKA |

TABLE 7B-3

| Vulcanizing Agents and Vulcanization Accelerators | | | |
|---|---|---|---|
| Abbreviation for material | Material name | Product name | Manufacturer |
| Sulfur | Sulfur | SULFAX PMC | Tsurumi Chemical Industry Co., Ltd. |
| TT | Tetramethylthiuram disulfide | NOCCELER TT-P | Ouchi Shinko Chemical Industrial Co., Ltd. |
| TBZTD | Tetrabenzylthiuram disulfide | Sanceler TBZTD | Sanshin Chemical Industry Co., Ltd. |
| TET | Tetraethylthiuram disulfide | Sanceler TET-G | Sanshin Chemical Industry Co., Ltd. |

Conductive Member 13

A conductive member C1 was produced proceeding as in Example 1, but using the materials and conditions given in Table 7A-1 and Table 7A-2. A conductive resin layer was then also placed on conductive member C1 in accordance with the following method to produce a charging roller 13, and measurement and evaluation were carried out as in Example 1. The results are given in Table 9.

Methyl isobutyl ketone was added as solvent to the caprolactone-modified acrylic polyol solution to adjust the solids fraction to 10 mass %. A mixed solution was prepared using the materials indicated in the following Table 8 per 1,000 parts (100 parts solid fraction) of this acrylic polyol solution. At this point, the mixture of blocked HDI and blocked IPDI gave "NCO/OH=1.0".

TABLE 8

| | Ingredient name | Amount of incorporation (parts) |
|---|---|---|
| Base | Caprolactone-modified acrylic polyol solution (solids fraction: 70 mass %)<br>(product name: PLACCEL DC2016, Daicel Corporation) | 100<br>(solids fraction) |
| Curing agent 1 | Blocked isocyanate A (IPDI, solids fraction = 60 mass %)<br>(product name: VESTANAT B1370, Degussa Japan Co., Ltd.) | 37<br>(solids fraction) |
| Curing agent 2 | Blocked isocyanate B (HDI, solids fraction = 80 mass %)<br>(product name: DURANATE TPA-B80E, Asahi Kasei Chemicals Corporation) | 24<br>(solids fraction) |
| Conducting agent | Carbon black (HAF)<br>(product name: Seast3, Tokai Carbon Co., Ltd.) | 15 |
| Additive 1 | Acicular rutile titanium oxide fine particles<br>(product name: MT-100T, TAYCA Corporation) | 35 |
| Additive 2 | Modified dimethylsilicone oil<br>(product name: SH28PA, Toray Dow Corning Silicone Corporation) | 0.1 |

210 g of the aforementioned mixed solution and 200 g of glass beads with an average particle diameter of 0.8 mm as media were then mixed in a 450-mL glass bottle, and a predispersion was performed for 24 hours using a paint shaker disperser to obtain a paint for forming a conductive resin layer.

Using its longitudinal direction for the vertical direction, the conductive member C1 was painted by a dipping procedure by immersion in the paint for forming a conductive resin layer. The immersion time for the dipping application was 9 seconds, the withdrawal speed was an initial speed of 20 mm/sec and a final speed of 2 mm/sec, and between these the speed was linearly varied with time.

The obtained coated article was air-dried for 30 minutes at normal temperature; then dried for 1 hour in a convection circulation dryer set to 90° C.; and subsequently dried for 1 hour in a convection circulation dryer set to 160° C. to obtain conductive member 13. The results of the evaluation are given in Table 9.

TABLE 9

| Conductive member No. | MD structure | Matrix Volume resistivity R1 (Ωcm) | Domain Volume resistivity R2 (Ωcm) | Matrix-domain structure R1/R2 | Dm (μm) | σm/Dm | Ld (μm) | Domain diameter D (μm) |
|---|---|---|---|---|---|---|---|---|
| 1 | Present | 5.83E+16 | 1.66E+01 | 3.5.E+15 | 0.21 | 0.24 | 0.20 | 0.20 |
| 2 | Present | 5.09E+16 | 1.26E+01 | 4.0.E+15 | 0.85 | 0.25 | 0.51 | 0.51 |
| 3 | Present | 1.10E+13 | 2.58E+01 | 4.3.E+11 | 0.22 | 0.24 | 0.22 | 0.22 |
| 4 | Present | 2.62E+12 | 6.23E+01 | 4.2.E+10 | 0.45 | 0.22 | 1.20 | 1.20 |
| 5 | Present | 2.09E+12 | 3.08E+06 | 6.8.E+05 | 0.44 | 0.35 | 0.19 | 0.19 |
| 6 | Present | 7.00E+15 | 2.17E+01 | 3.2.E+14 | 1.92 | 0.23 | 1.12 | 1.12 |
| 7 | Present | 4.81E+15 | 9.03E+03 | 5.33E+11 | 2.90 | 0.22 | 2.35 | 2.35 |
| 8 | Present | 5.64E+12 | 3.89E+03 | 1.4.E+09 | 0.19 | 0.19 | 1.82 | 1.82 |
| 9 | Present | 2.98E+16 | 1.04E+01 | 2.9.E+15 | 1.15 | 0.23 | 0.23 | 0.23 |
| 10 | Present | 5.42E+15 | 2.20E+01 | 2.5.E+14 | 0.52 | 0.45 | 2.33 | 2.33 |
| 11 | Present | 2.58.E+09 | 5.21E+01 | 5.0.E+07 | 0.23 | 0.26 | 2.30 | 2.30 |
| 12 | Present | 9.18E+02 | 2.56E+15 | 3.6.E−13 | 2.20 | 0.22 | 2.50 | 2.50 |
| 13 | Absent | — | — | — | None | — | None | None |

In the table, for example, "5.83E+16" indicates "$5.83\times10^{16}$", and "3.6E−13" indicates "$3.6\times10^{-13}$". The "MD structure" refers to the presence/absence of a matrix-domain structure.

Example 1

A laser printer with an electrophotographic system (product name: LBP9950Ci, Canon, Inc.) was prepared as the electrophotographic apparatus. The toner 1, conductive member 1, electrophotographic apparatus, and process cartridge were then held for 72 hours in a 35° C./85% RH environment for conditioning into the measurement environment.

In order to perform the evaluations with a high-speed process, modifications were carried out as follows. The modifications were: by changing the gearing and software in the body of the evaluation machine, the rotation rate of the developing roller was set to rotate at a peripheral velocity that was 1.5× that of the drum; the process speed was changed to 360 mm/sec.

The toner present in the toner cartridge of the LBP9950Ci was removed; the interior was cleaned with an air blower; and 180 g of the toner 1 to be evaluated was loaded therein. The conductive member 1 was installed as the charging roller of the process cartridge; this was installed in the laser printer; and the pre-exposure device in the laser printer was removed.

The printer+process cartridge assembly corresponded to the structure given in FIG. 5.

The initial evaluation image was then output; operating in the indicated environment, 20,000 prints were printed out in the A4 paper width direction of an image having a print percentage of 1.5%, in the center with 50-mm margins on both the left and right; and the evaluations were carried out after the output of the 20,000 prints. A4 color laser copy paper (Canon, Inc., 80 g/m$^2$) was used as the evaluation paper. The results of the evaluations are given in Table 10.

Evaluation of Image Smearing

Evaluation image: a 1 dot-2 space horizontal ruled line image was formed on the A4 paper at a toner laid-on level on the delivered paper of 0.35 mg/cm$^2$ (adjusted using the direct current voltage $V_{DC}$ of the developer bearing member, the charging voltage $V_D$ of the electrostatic latent image bearing member, and the laser power).

A print of this evaluation image was output both initially and after the output of 20,000 prints. The thickness of the ruled lines was compared pre-durability-test versus post-durability-test. The "ruled line width thinning percentage" was calculated using the formula given below. The obtained ruled line width thinning percentage was evaluated using the evaluation criteria given below. The thickness of the ruled lines in the image is the average value of the thickness of 30 ruled lines in the image on one print. A C or better was regarded as good.

ruled line width thinning percentage={(ruled line thickness in image pre-durability-test−ruled line thickness in image post-durability-test)/ruled line thickness in image pre-durability-test}×100

Evaluation Criteria

A: the ruled line width thinning percentage is less than 5.0%

B: the ruled line width thinning percentage is at least 5.0%, but less than 10.0%

C: the ruled line width thinning percentage is at least 10.0%, but less than 15.0%

D: the ruled line width thinning percentage is at least 15.0%, but less than 20.0%

E: the ruled line width thinning percentage is at least 20.0%

Evaluation of Member Contamination

Evaluation image: a solid image was formed on the aforementioned A4 paper at a toner laid-on level of 0.60 mg/cm$^2$ (adjusted using the direct current voltage $V_{DC}$ of the developer bearing member, the charging voltage $V_D$ of the electrostatic latent image bearing member, and the laser power).

With regard to the level of toner fusion to the charging roller and photosensitive member caused by contamination of the charging roller by toner, the status of toner fusion at the surface of the photosensitive member and the influence (blank dots) produced by this on the image were visually evaluated.

Evaluation Criteria

A: no occurrence

B: toner fusion is present, but is very minor and not conspicuous

C: toner fusion is numerous and image defects, of punctiform blanks in the solid black image, are conspicuous D: large toner fusion occurs and image defects, of line-shaped blanks of several mm, are conspicuous Examples 2 to 12 and Comparative Examples 1 to 6

The evaluations in Examples 2 to 12 and Comparative Examples 1 to were carried out as in Example 1, but changing the toner/charging roller combination as shown in Table 10.

TABLE 10

| | Toner | Charging roller | Image smearing Rank | Image smearing (%) | Member contamination Rank |
|---|---|---|---|---|---|
| Example 1 | Toner 1 | Charging roller 1 | A | 4.1 | A |
| Example 2 | Toner 2 | Charging roller 2 | A | 3.2 | A |
| Example 3 | Toner 1 | Charging roller 3 | A | 4.6 | A |
| Example 4 | Toner 2 | Charging roller 4 | B | 8.5 | A |
| Example 5 | Toner 1 | Charging roller 5 | B | 9.6 | A |
| Example 6 | Toner 2 | Charging roller 6 | B | 7.4 | A |
| Example 7 | Toner 1 | Charging roller 7 | C | 12.3 | A |
| Example 8 | Toner 2 | Charging roller 8 | C | 13.1 | A |
| Example 9 | Toner 3 | Charging roller 9 | A | 3.5 | A |
| Example 10 | Toner 4 | Charging roller 1 | C | 14.8 | B |
| Example 11 | Toner 5 | Charging roller 1 | B | 9.2 | B |
| Example 12 | Toner 2 | Charging roller 10 | C | 13.5 | A |
| Example 13 | Toner 6 | Charging roller 3 | C | 13.5 | B |
| Example 14 | Toner 7 | Charging roller 3 | C | 14.5 | C |
| Comparative Example 1 | Toner 8 | Charging roller 3 | D | 18.2 | B |
| Comparative Example 2 | Toner 2 | Charging roller 11 | E | 23.7 | B |
| Comparative Example 3 | Toner 2 | Charging roller 12 | E | 25.4 | B |
| Comparative Example 4 | Toner 2 | Charging roller 13 | E | 27.1 | B |

While the present invention has been described with reference to exemplary embodiments, itis to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-191585, filed Oct. 18, 2019, which is hereby incorporated by reference herein in its entirety.

What is claimed is:

1. An electrophotographic apparatus, comprising:

an electrophotographic photosensitive member;

a charging unit configured to charge a surface of the electrophotographic photosensitive member, the charging unit comprising a conductive member disposed to be contactable with the electrophotographic photosensitive member; and a developing unit comprising toner and being configured to develop an electrostatic latent image formed on the surface of the electrophotographic photosensitive member with a toner to form a toner image on the surface of the electrophotographic photosensitive member, the toner comprising a toner particle containing a binder resin, and an external additive comprising a fine particle of a hydrotalcite compound, wherein the conductive member comprises a support having a conductive outer surface and a conductive layer disposed on the outer surface of the support, the conductive layer comprises a matrix with a plurality of domains dispersed in the matrix, at least some of the domains being exposed at an outer surface of the conductive member, the outer surface of the conductive member comprises the matrix and the domains that are exposed therein, the matrix contains a first rubber, and each of the domains contains a second rubber and an electronic conducting agent, and $1.00\times10^{12}$ Ω·cm<R1≤$1.00\times10^{17}$ Ω·cm and R1 is at least $1.0\times10^{5}$ times R2 where R1 is a volume resistivity of the matrix and R2 is a volume resistivity of the domains.

2. The electrophotographic apparatus according to claim 1, wherein the fine particles of hydrotalcite compound have a number-average primary particle diameter of 0.10 to 1.00 μm.

3. The electrophotographic apparatus according to claim 1, wherein 0.15≤Dm≤2.00 μm when Dm is an arithmetic-mean value of a distance between adjacent walls of the domains in the conductive layer in observation of a cross section of the conductive member.

4. The electrophotographic apparatus according to claim 1, wherein Ld≥Lh when Lh (μm) is a number-average primary particle diameter of the fine particles of the hydrotalcite compound and Ld (μm) is an arithmetic-mean value of circle-equivalent diameters of the domains in the conductive layer in observation of the outer surface of the conductive member.

5. The electrophotographic apparatus according to claim 1, wherein a variation coefficient σm/Dm for the distance between adjacent walls of the domains is 0 to 0.40 when Dm is an arithmetic-mean value of a distance between adjacent walls of the domains in the conductive layer in observation of a cross section of the conductive member and σm is a standard deviation of distribution of Dm.

6. The electrophotographic apparatus according to claim 1, wherein an immobilization percentage of the fine particle of the hydrotalcite compound on the toner particle is 20 to 60%.

7. A process cartridge detachably provided to a main body of an electrophotographic apparatus, the process cartridge comprising a charging unit configured to charge a surface of an electrophotographic photosensitive member; and a developing unit comprising toner and being configured to develop an electrostatic latent image formed on the surface of the electrophotographic photosensitive member to form a toner image on the surface of the electrophotographic photosensitive member, the toner comprising a toner particle containing a binder resin, and an external additive comprising a fine particle of a hydrotalcite compound, wherein the conductive member comprises a support having a conductive outer surface and a conductive layer disposed on the outer surface of the support, the conductive layer comprises a matrix with a plurality of domains dispersed in the matrix, at least some of the domains being exposed at an outer surface of the conductive member, the outer surface of the conductive member comprises the matrix and the domains that are exposed therein, the matrix contains a first rubber, and each of the domains contains a second rubber and an electronic conducting agent, $1.00\times10^{12}$ Ω·cm<R1≤$1.00\times10^{17}$ Ω·cm and R1 is at least $1.0\times10^{5}$ times R2 where R1 is a volume resistivity of the matrix and R2 is a volume resistivity of the domains.

8. A cartridge set comprising a first cartridge and a second cartridge detachably provided to a main body of an electrophotographic apparatus;

the first cartridge comprising a charging unit configured to charge a surface of an electrophotographic photosensitive member and a first frame supporting the charging unit, the charging unit comprising a conductive member disposed to be contactable with the electrophotographic photosensitive member;

the second cartridge comprising a toner container that holds a toner for forming a toner image on the surface of the electrophotographic photosensitive member by developing an electrostatic latent image formed on the surface of the electrophotographic photosensitive member;

the toner comprising a toner particle containing a binder resin, and an external additive comprising a fine particle of a hydrotalcite compound; and the conductive member comprises a support having a conductive outer surface and a conductive layer disposed on the outer surface of the support, wherein the conductive layer comprises a matrix with a plurality of domains dispersed in the matrix, at least some of the domains being exposed at an outer surface of the conductive member, the outer surface of the conductive member comprises the matrix and the domains that are exposed therein, the matrix contains a first rubber, and each of the domains contains a second rubber and an electronic conducting agent, $1.00\times10^{12}$ Ω·cm<R1≤$1.00\times10^{17}$ Ω·cm and R1 is at least $1.0\times10^{5}$ times R2 where R1 is a volume resistivity of the matrix and R2 is a volume resistivity of the domains.

* * * * *